US008906285B2

(12) United States Patent
Aksay et al.

(10) Patent No.: US 8,906,285 B2
(45) Date of Patent: Dec. 9, 2014

(54) ELECTROHYDRODYNAMIC PRINTING AND MANUFACTURING

(75) Inventors: Ilhan A. Aksay, Princeton, NJ (US); Dudley A. Saville, Princeton, NJ (US); Joy Wagner Saville, legal representative, Princeton, NJ (US); Hak Fei Poon, Niskayuna, NY (US); Sibel Korkut, Princeton, NJ (US); Chuan-hua Chen, Thousand Oaks, CA (US)

(73) Assignee: The Trustees of Princeton University, Princeton, NJ (US)

( * ) Notice: Subject to any disclaimer, the term of this patent is extended or adjusted under 35 U.S.C. 154(b) by 1359 days.

(21) Appl. No.: 12/092,152

(22) PCT Filed: Oct. 31, 2006

(86) PCT No.: PCT/US2006/042468

§ 371 (c)(1),
(2), (4) Date: Sep. 8, 2008

(87) PCT Pub. No.: WO2007/053621

PCT Pub. Date: May 10, 2007

(65) Prior Publication Data

US 2009/0233057 A1 Sep. 17, 2009

Related U.S. Application Data

(60) Provisional application No. 60/731,479, filed on Oct. 31, 2005.

(51) Int. Cl.

| | |
|---|---|
| ***H01B 7/00*** | (2006.01) |
| ***D01D 5/00*** | (2006.01) |
| ***B41J 2/06*** | (2006.01) |

(52) U.S. Cl.

CPC ..... *D01D 5/0061* (2013.01); *D01D 5/0023* (2013.01); *D01D 5/0038* (2013.01); *D01D 5/003* (2013.01); *B41J 2/06* (2013.01)

USPC ..... 264/465

(58) Field of Classification Search

USPC ..... 264/10, 464, 465, 466, 484

See application file for complete search history.

(56) References Cited

U.S. PATENT DOCUMENTS

| | | | |
|---|---|---|---|
| 7,658,901 | B2 | 2/2010 | Prud'Homme et al. |
| 7,659,350 | B2 | 2/2010 | Prud'Homme et al. |

(Continued)

FOREIGN PATENT DOCUMENTS

| | | | |
|---|---|---|---|
| CN | 1119843 | A | 4/1996 |
| EP | 1 364 718 | A1 | 11/2003 |

(Continued)

OTHER PUBLICATIONS

Wong et al. "Graphene Nanoplatelet ReinforcedPolymer Coatings", Annual Technical Conference—Society of Plastics Engineers, 62nd (vol. 2), pp. 1733-1737 (2004).*

(Continued)

*Primary Examiner* — Leo B Tentoni

(74) *Attorney, Agent, or Firm* — Oblon, Spivak, McClelland, Maier & Neustadt, L.L.P.

(57) ABSTRACT

An stable electrohydrodynamic filament is obtained by causing a straight electrohydrodynamic filament formed from a liquid to emerge from a Taylor cone, the filament having a diameter of from 10 nm to 100 μm. Such filaments are useful in electrohydrodynamic printing and manufacturing techniques and their application in liquid drop/particle and fiber production, colloidal deployment and assembly, and composite materials processing.

18 Claims, 27 Drawing Sheets

Setup for electrohydrodynamic printing of polymer fiber.

(56) References Cited

U.S. PATENT DOCUMENTS

| | | | | |
|---|---|---|---|---|
| 7,745,528 | B2 | 6/2010 | Prud'Homme et al. | |
| 7,771,824 | B2 | 8/2010 | Herrera-Alonso et al. | |
| 2001/0003148 | A1* | 6/2001 | Coffee | 602/42 |
| 2003/0137083 | A1* | 7/2003 | Ko et al. | 264/465 X |
| 2003/0215624 | A1 | 11/2003 | Layman et al. | |
| 2003/0217928 | A1* | 11/2003 | Lin et al. | 205/109 |
| 2005/0073075 | A1* | 4/2005 | Chu et al. | 264/465 |
| 2005/0123688 | A1 | 6/2005 | Craighead et al. | |
| 2008/0302561 | A1 | 12/2008 | Prud'Homme et al. | |
| 2008/0312368 | A1 | 12/2008 | Prud'Homme et al. | |
| 2009/0053433 | A1 | 2/2009 | Prud'Homme et al. | |
| 2009/0053437 | A1 | 2/2009 | Prud'Homme et al. | |
| 2009/0054272 | A1 | 2/2009 | Prud'Homme et al. | |
| 2009/0054578 | A1 | 2/2009 | Prud'Homme et al. | |
| 2009/0054581 | A1 | 2/2009 | Prud'Homme et al. | |
| 2009/0123752 | A1 | 5/2009 | Prud'Homme et al. | |
| 2009/0123843 | A1 | 5/2009 | Aksay et al. | |
| 2009/0127514 | A1 | 5/2009 | Korkut et al. | |
| 2010/0096595 | A1 | 4/2010 | Prud'Homme et al. | |
| 2012/0145234 | A1 | 6/2012 | Roy-Mayhew et al. | |

FOREIGN PATENT DOCUMENTS

| | | | |
|---|---|---|---|
| WO | WO 03/004735 | A1 | 1/2003 |
| WO | WO 2005/026398 | A2 | 3/2005 |
| WO | WO 2005/026398 | A3 | 3/2005 |

OTHER PUBLICATIONS

Office Action issued Dec. 14, 2010, in China Patent Application. No. 200680044963.5 (with English translation).

Gao Xushan, et al., "Nano-textile and the Application Thereof", Chemical Industry Press, 1st edition and 1st print, Oct. 31, 2004, 3 pages.

U.S. Appl. No. 12/791,190, filed Jun. 1, 2010, Prud'Homme, et al.

U.S. Appl. No. 12/866,089, filed Aug. 4, 2010, Crain, et al.

U.S. Appl. No. 12/866,079, filed Aug. 4, 2010, Crain, et al.

U.S. Appl. No. 12/945,043, filed Nov. 12, 2010, Pan, et al.

U.S. Appl. No. 13/077,070, filed Mar. 31, 2011, Prud'Homme, et al.

Office Action issued on Jun. 30, 2011 in the corresponding European Application No. 06 827 171.7.

Japanese Office Action issued Aug. 9, 2011, in Patent Application No. 2008-538969 (with English-language translation).

U.S. Appl. No. 12/866,306, filed Aug. 5, 2010, Aksay, et al.

U.S. Appl. No. 13/510,678, filed Jun. 14, 2012, Roy-Mayhew, et al.d.

Office Action issued Mar. 21, 2012, in Japanese Patent Application No. 2008-538969 (with English-language translation).

U.S. Appl. No. 13/603,818, filed Sep. 5, 2012, Crain, et al.

Office Action issued Dec. 14, 2012 in Korean Patent Application No. 10-2008-7013152 (18 pages) with English Translation.

U.S. Appl. No. 14/189,501, filed Feb. 25, 2014, Crain, et al.

U.S. Appl. No. 14/017,869, filed Sep. 4, 2013, Aksay, et al.

* cited by examiner

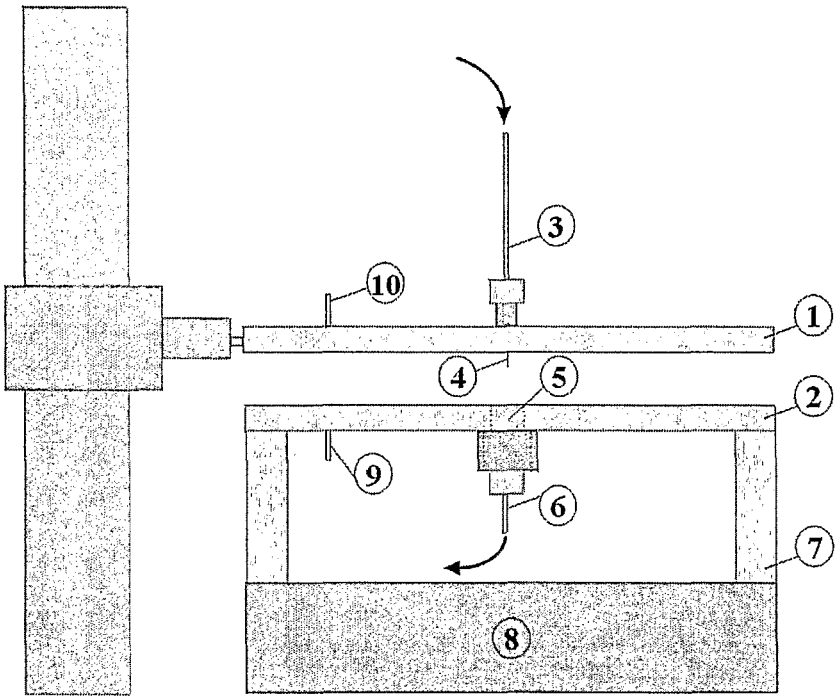
Figure 1: Experimental setup for stability experiments

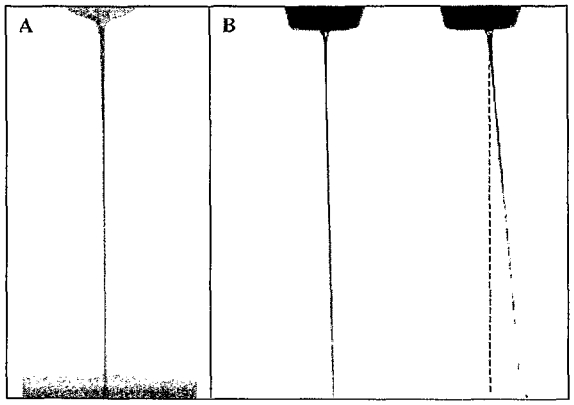
Figure 2: Experiments demonstrating stability difference resulting from electrode separation difference: A) At 6.5 mm separation, B) At 38.5 mm separation

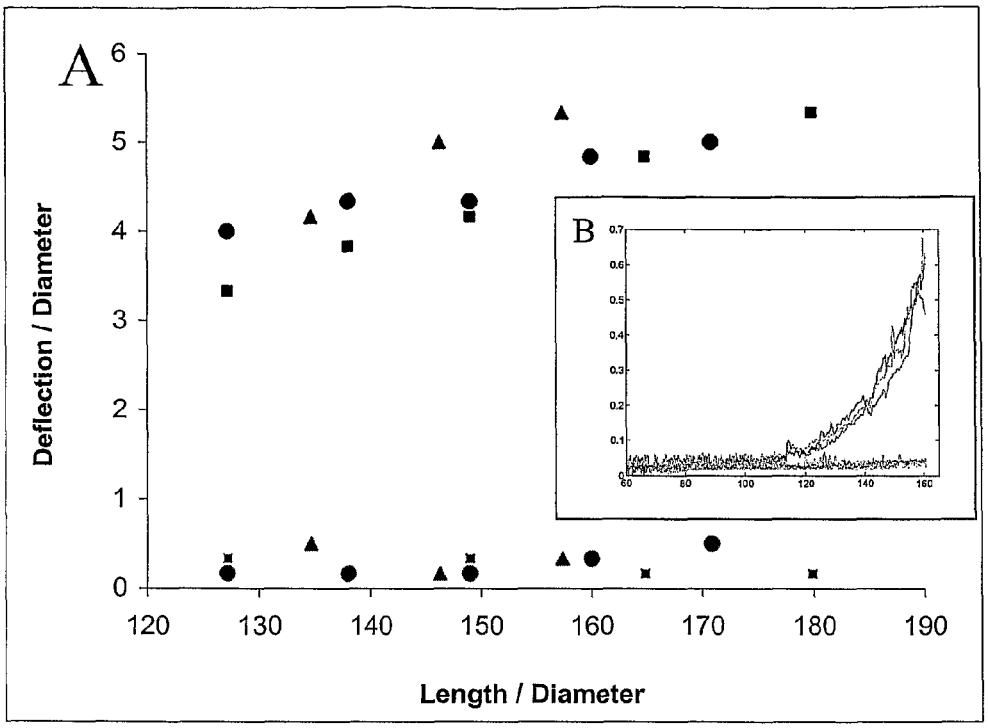
Figure 3: Maximum deflection of the filament from its centerline as a function of filament length.

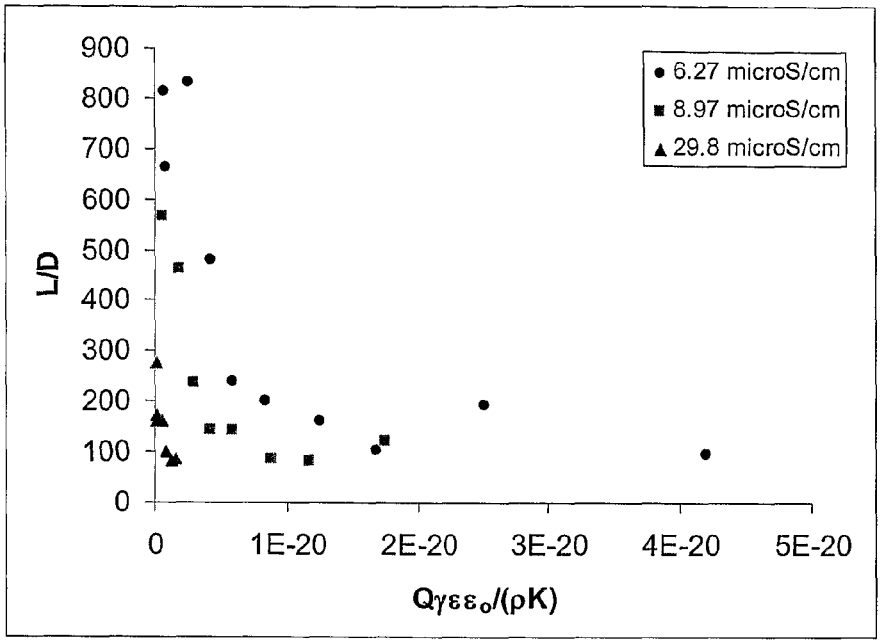
Figure 4: Variation of the straight section of the EHD filament as a function of volumetric flow rate for three different glycerol mixtures

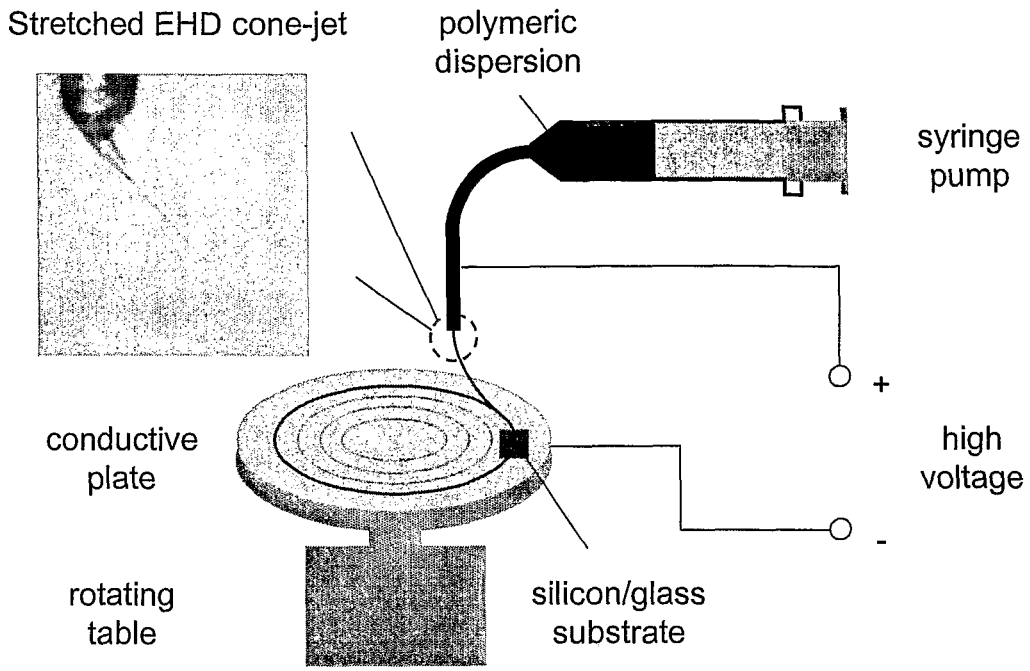
Figure 5. Setup for electrohydrodynamic printing of polymer fiber.

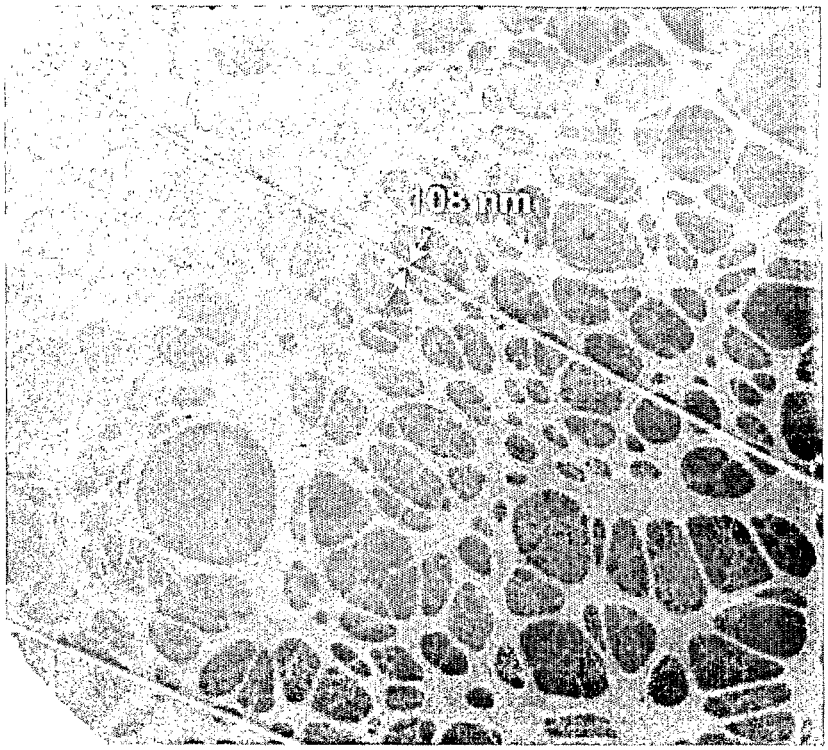
Figure 6. EHD printed polymer fiber of 100 nm diameter produced.

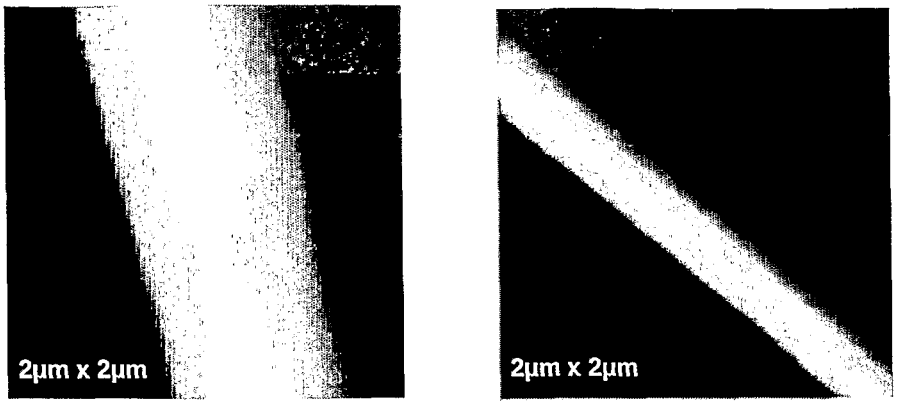
0.49 x 1.2 $\mu m^2$
(a) linear speed = 2.5 m/s
0.11 x 0.45 $\mu m^2$
(b) linear speed = 21 m/s
Figure 7. Effects of mechanical stretching on fiber diameter.

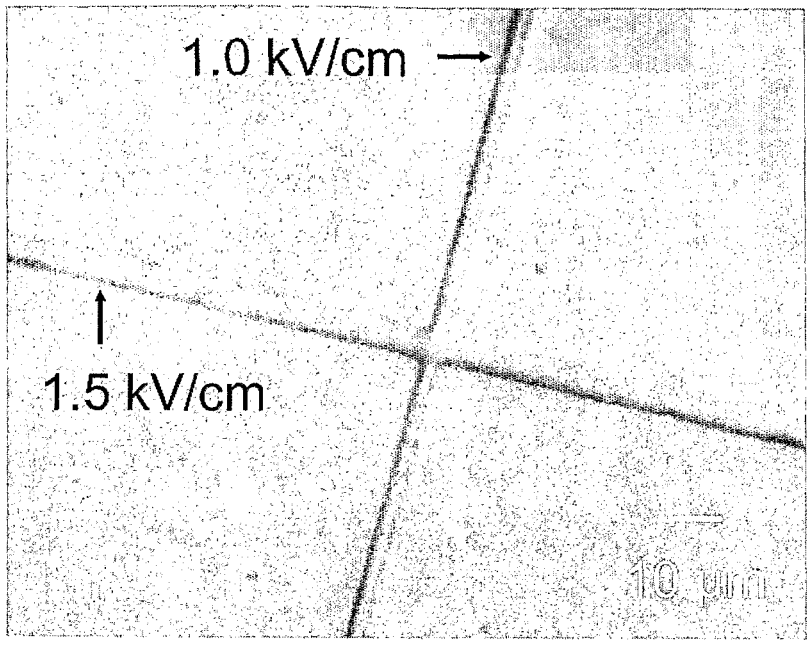
Figure 8. Fiber diameter controlled by electric field.

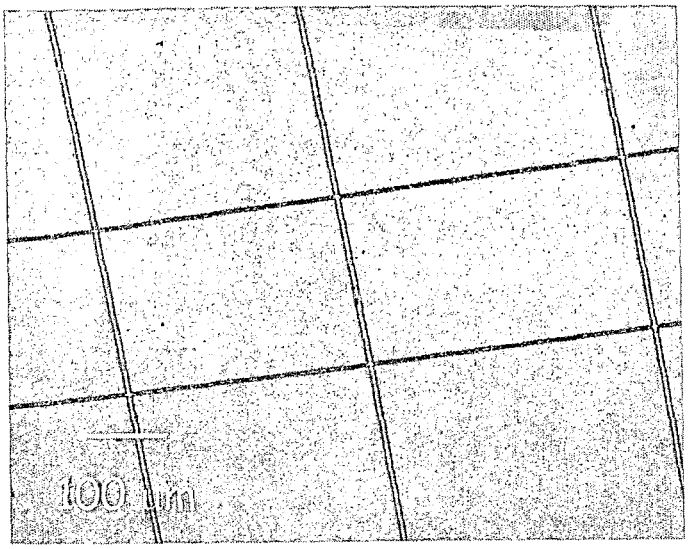
(a) PEO fiber mat
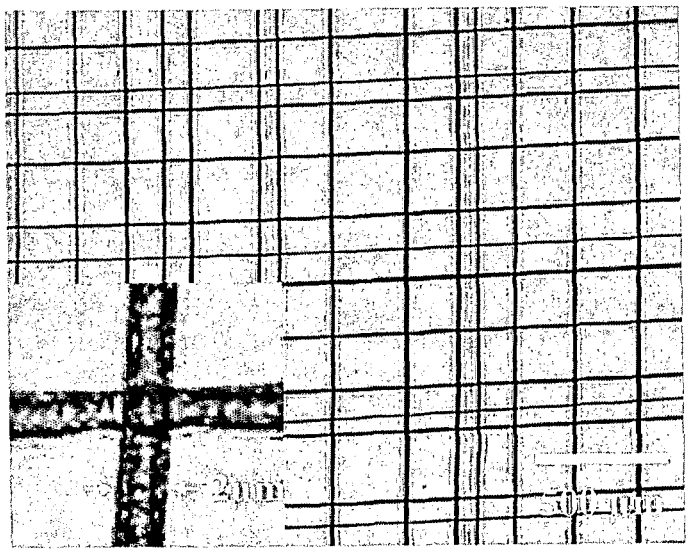
(2) CNT-Polyimide fiber mat
Figure 9. EHD printed fiber mat.

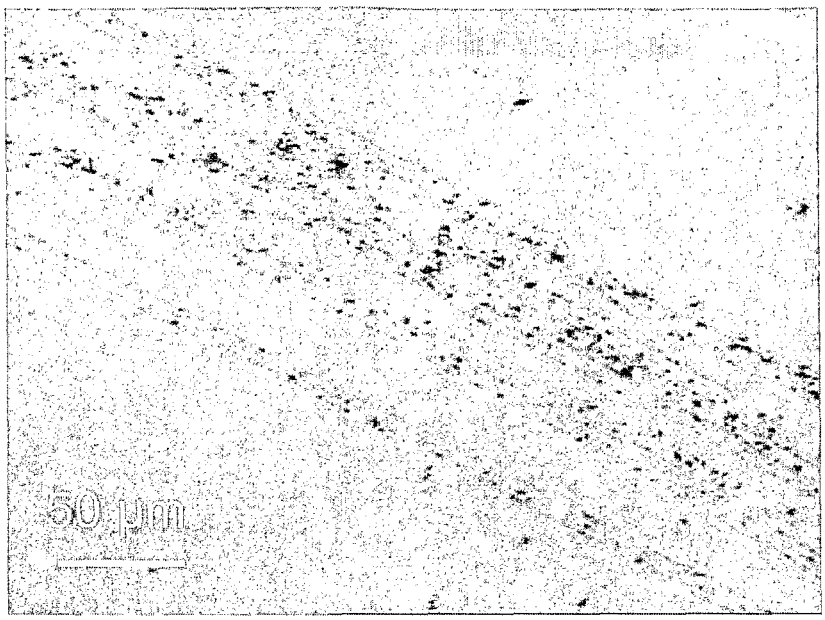
Figure 10. Conductive polymer: Thermally exfoliated graphite oxide (TEGO) in PEO.

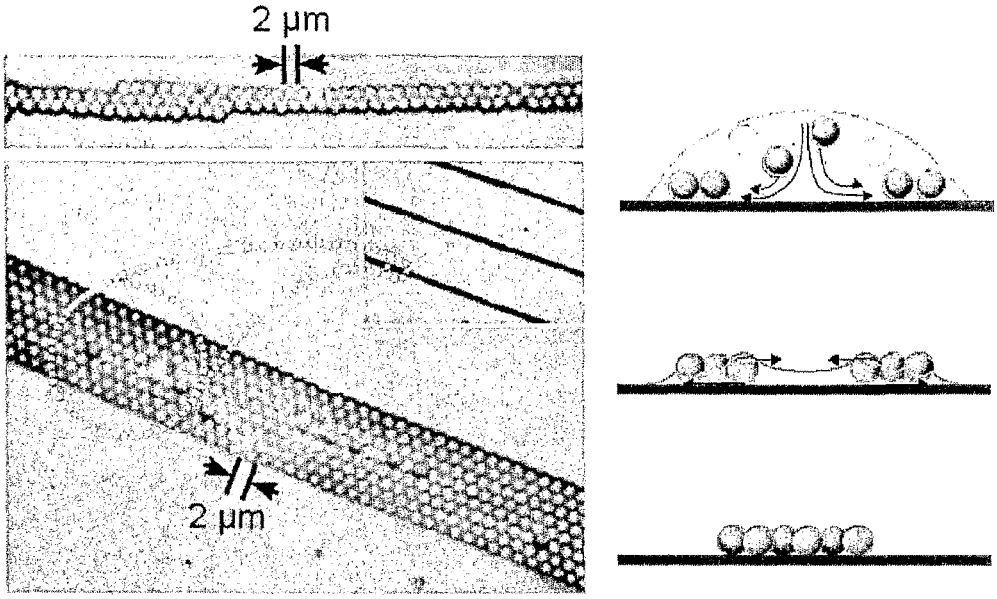
Figure 11. A) Almost perfectly crystalline linear arrays of microspheres produced by electrohydrodynamic printing. B,C,D) Schematic illustrating the colloidal self assembly mechanism.

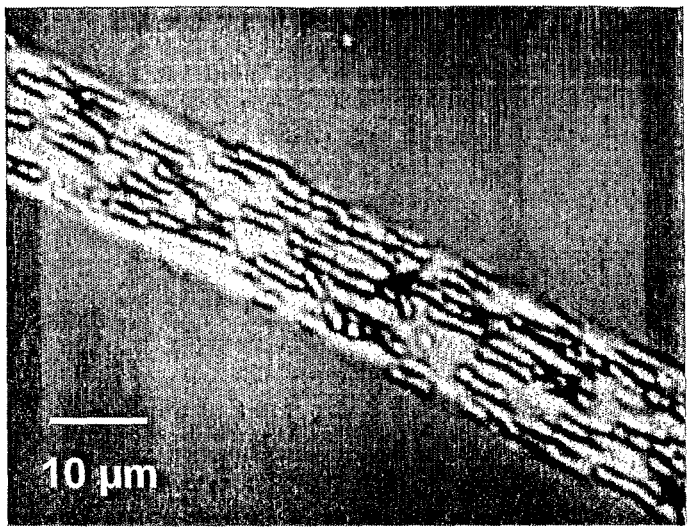
Figure 12. Alignment of rod-like particles in EHD polymeric fiber.

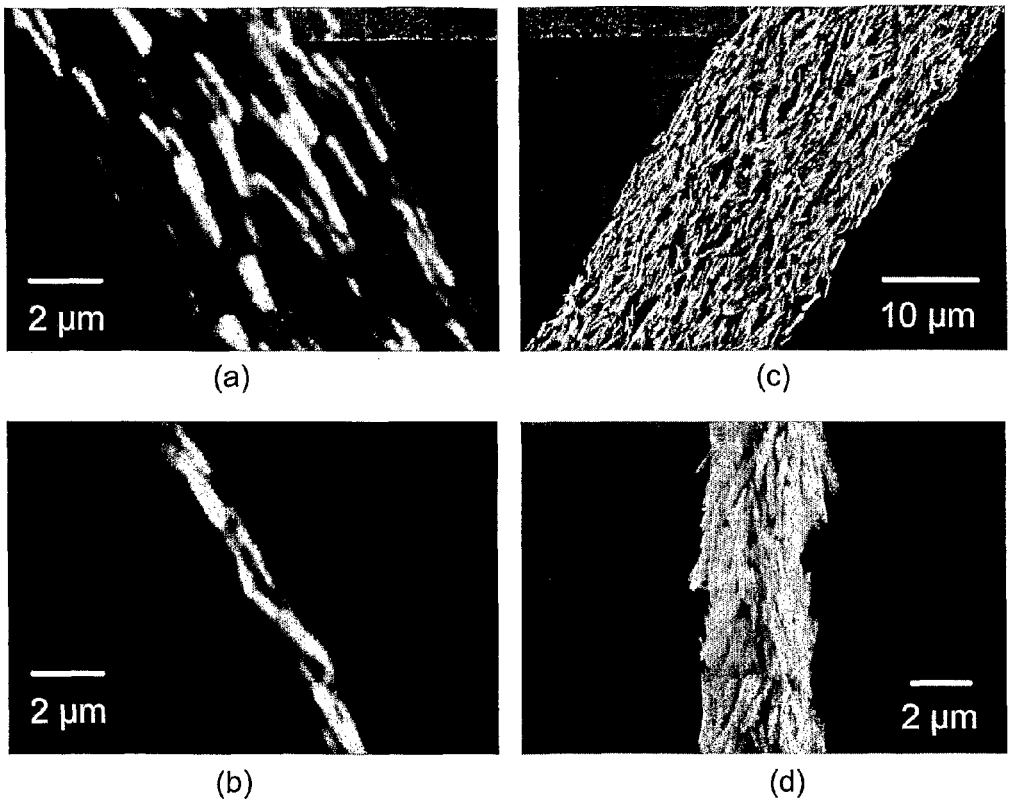
Figure 13. Alignment of anisotropic particle by EHD printing (a, b) and by mechanical stretching (c, d).

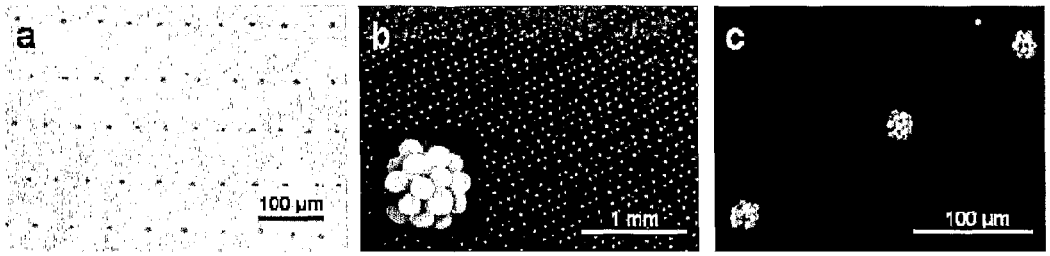
Figure 14: Patterns produced by continuous printing with EHD filament on a hydrophobic surface.

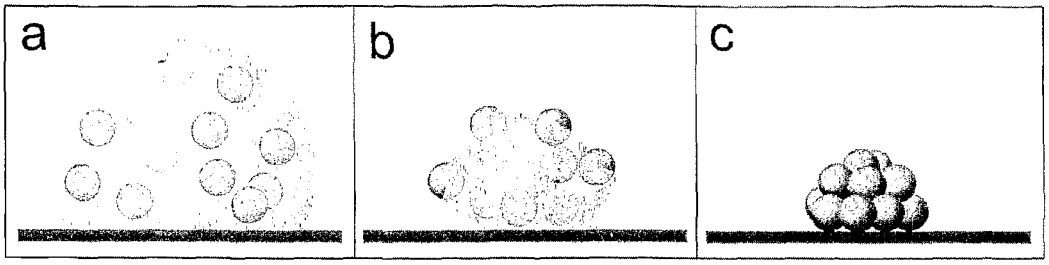
Figure 15: Schematic side view of 3D colloidal crystal formation after filament deployment.

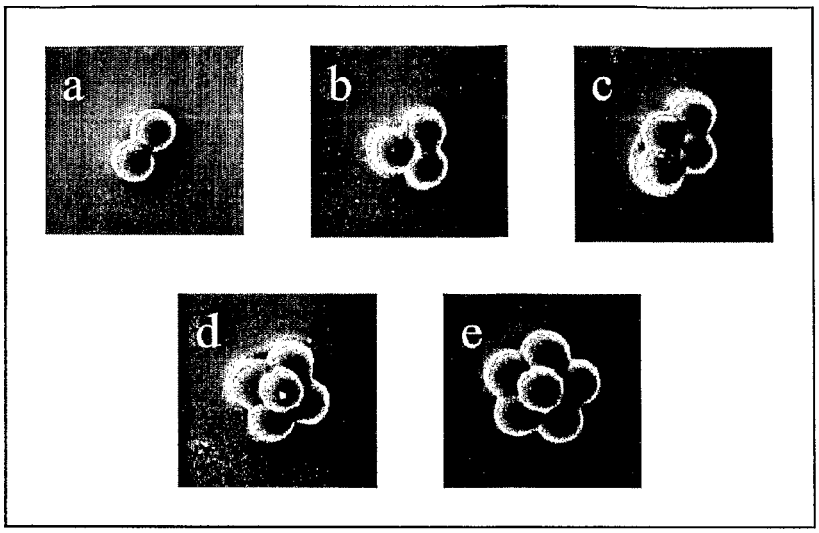
Figure 16: The most common structures of colloidal aggregates composed of different number of polystyrene particles per cluster.

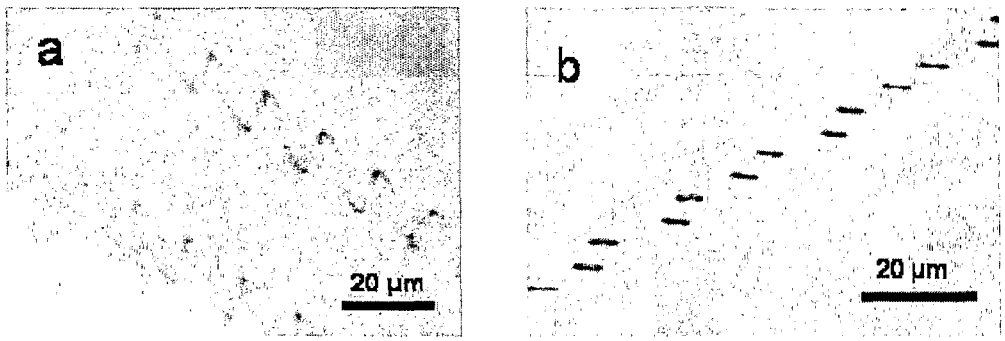
Figure 17: Patterns produced by continuous printing with EHD filament on a hydrophilic/hydrophobic pre-patterned surface.

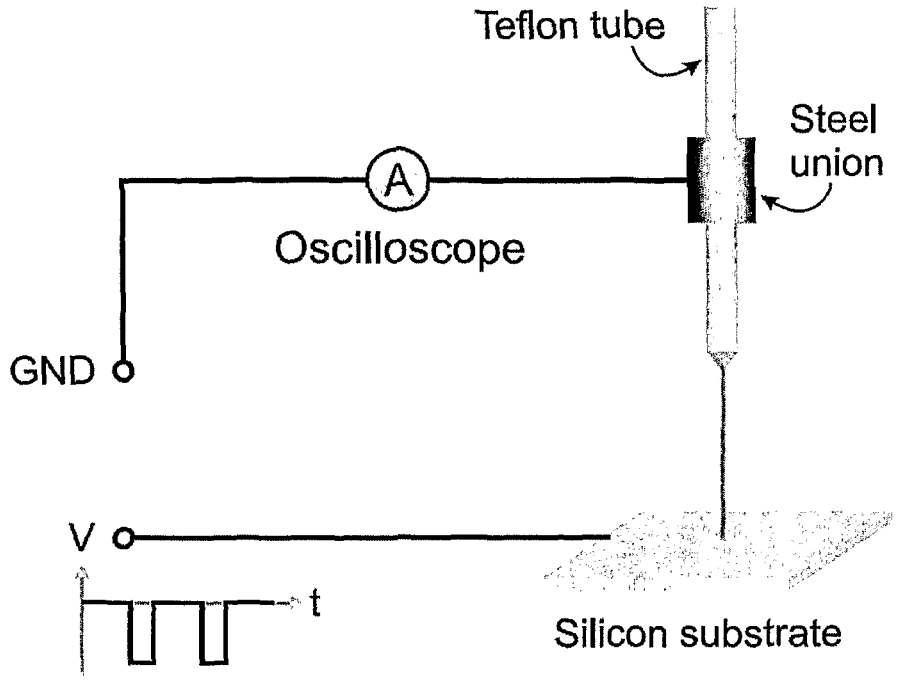
Figure 18: Experimental setup for pulsed EHD drop generation.

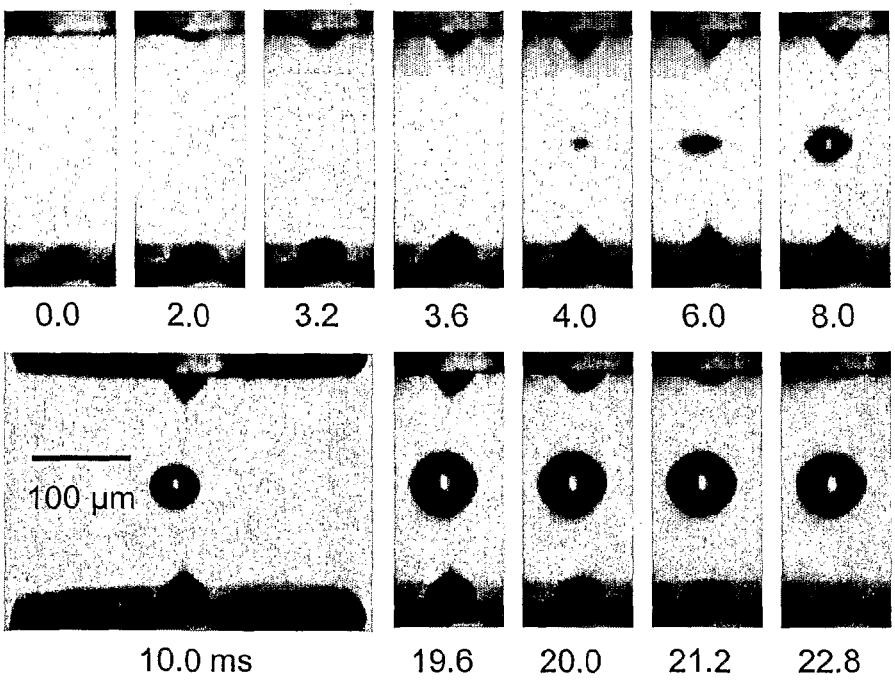
(a) Microscopic imaging
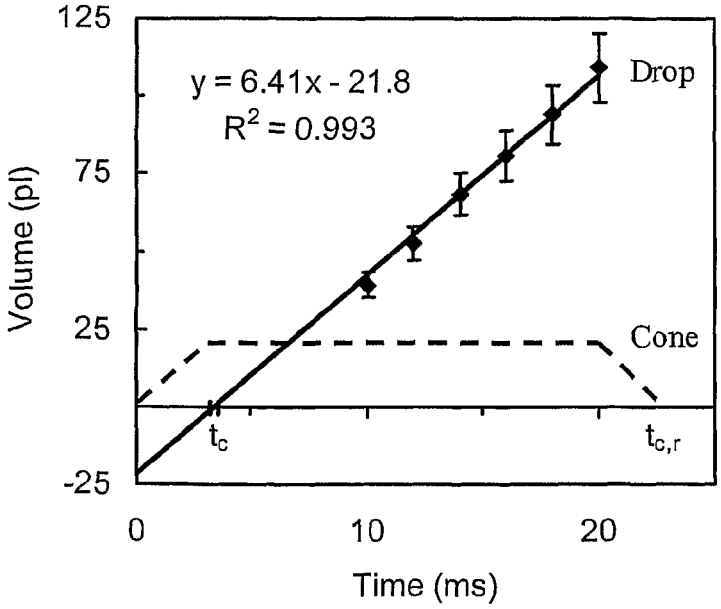
(b) Drop volume vs. time
Figure 19: EHD drop generation process.

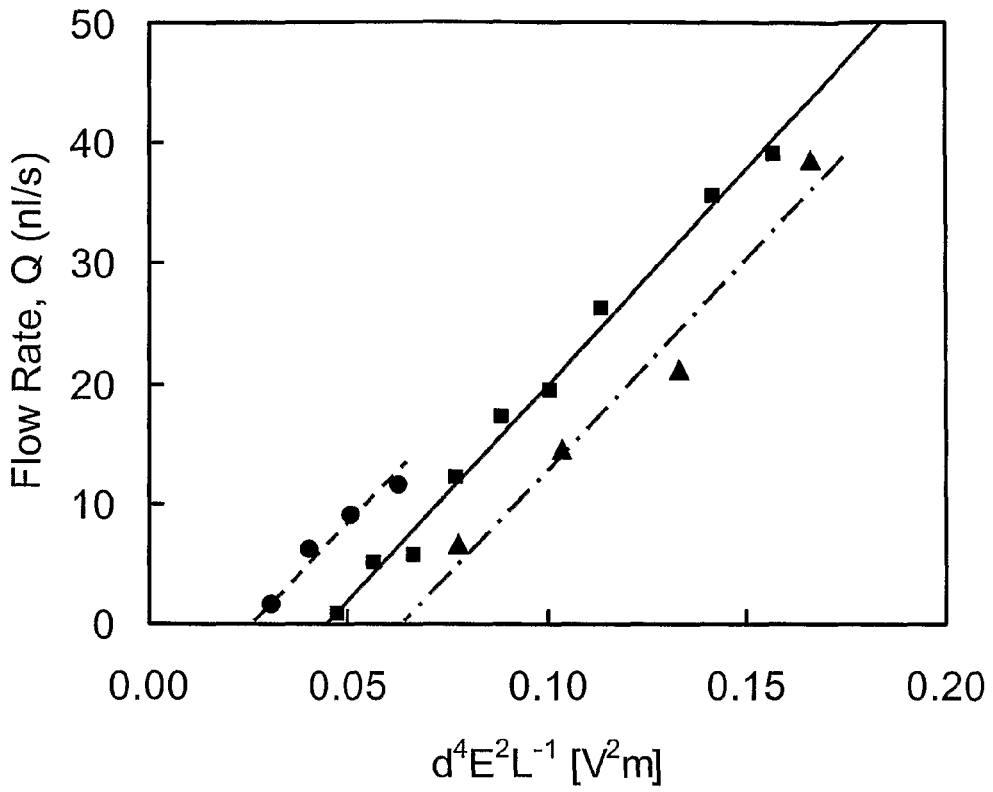
Figure 20: Flow rate of drop formation supporting $Q \sim d^4 E^2 L^{-1}$ scaling law.

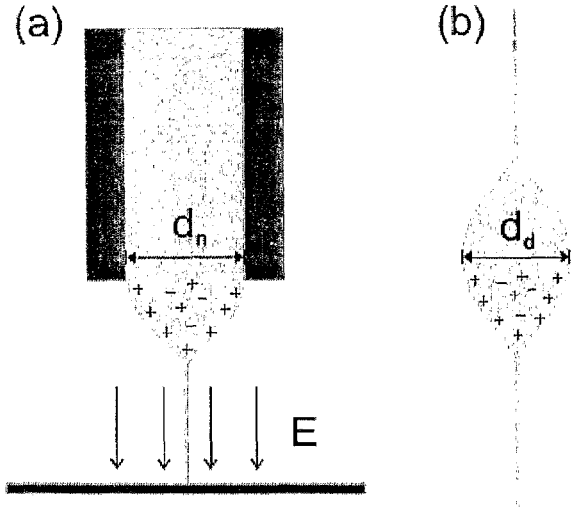
Figure 21: Analogy of transient cone-jets on (a) a supported meniscus and (b) an exploding drop.

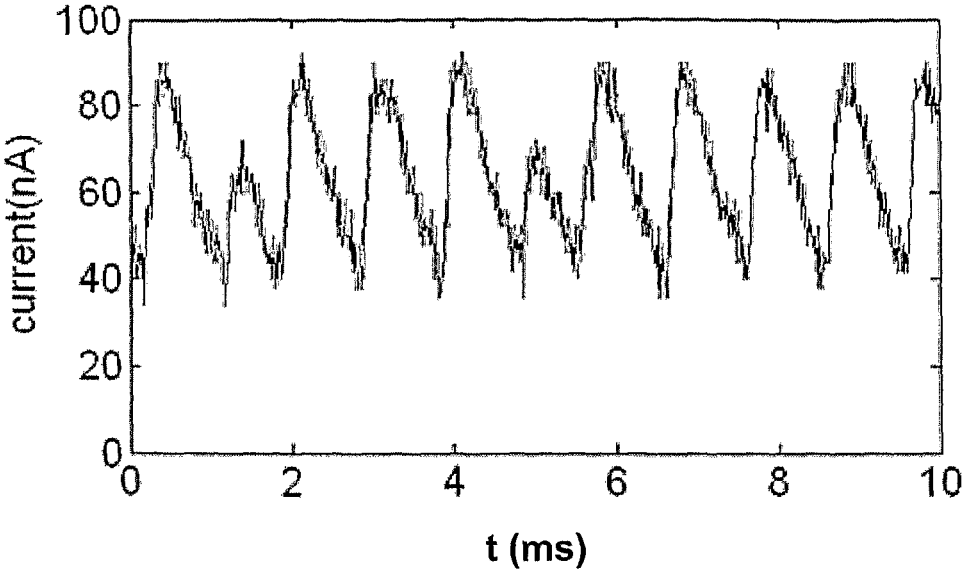
Figure 22: Current measurement in the EHD circuit.

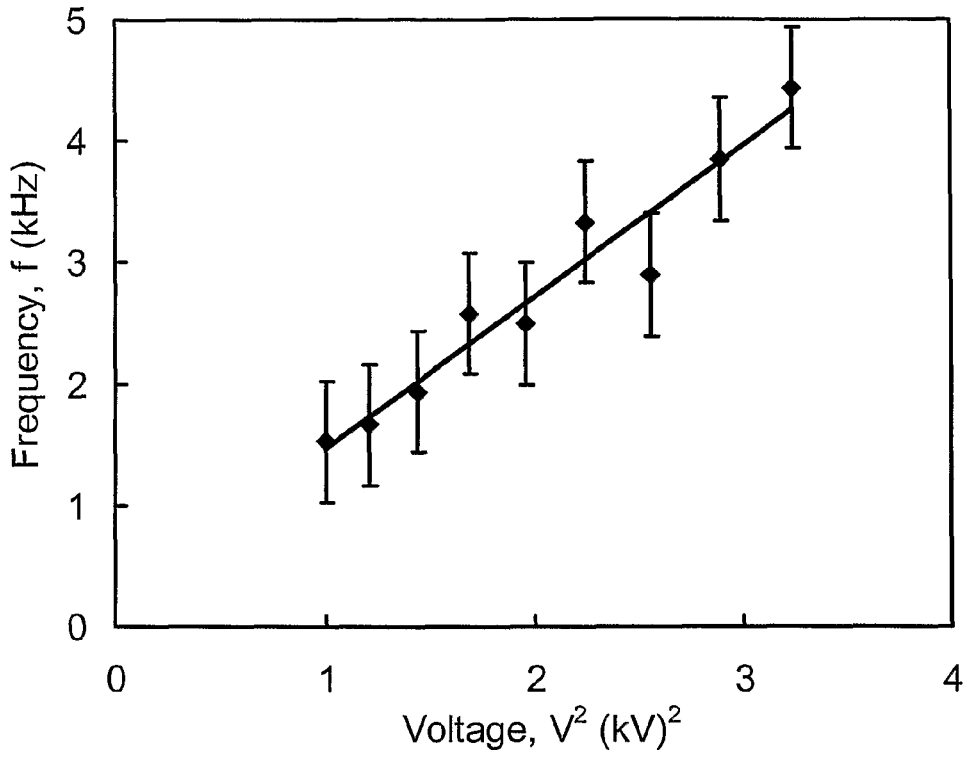
Figure 23: Frequency of intrinsic pulsation as a function of applied voltage.

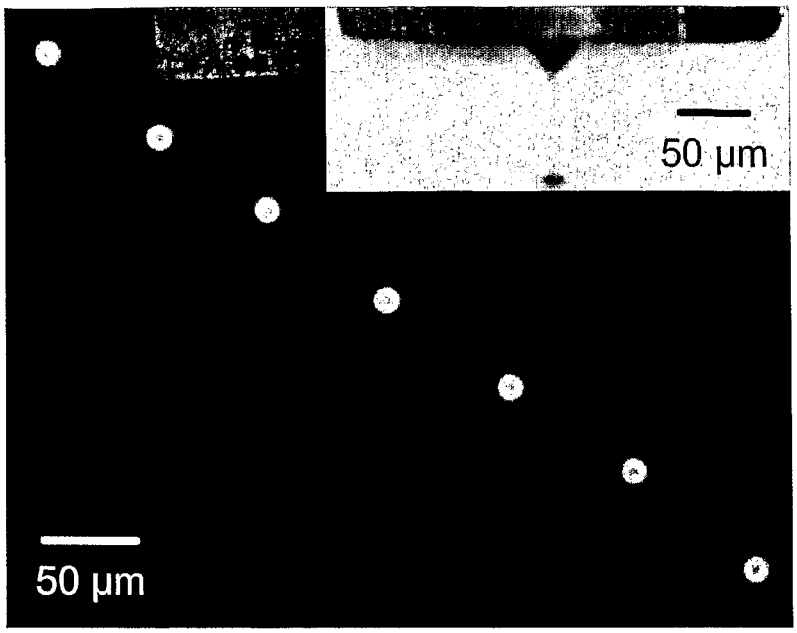
Figure 24: Drop array produced by a pulsed EHD jet.

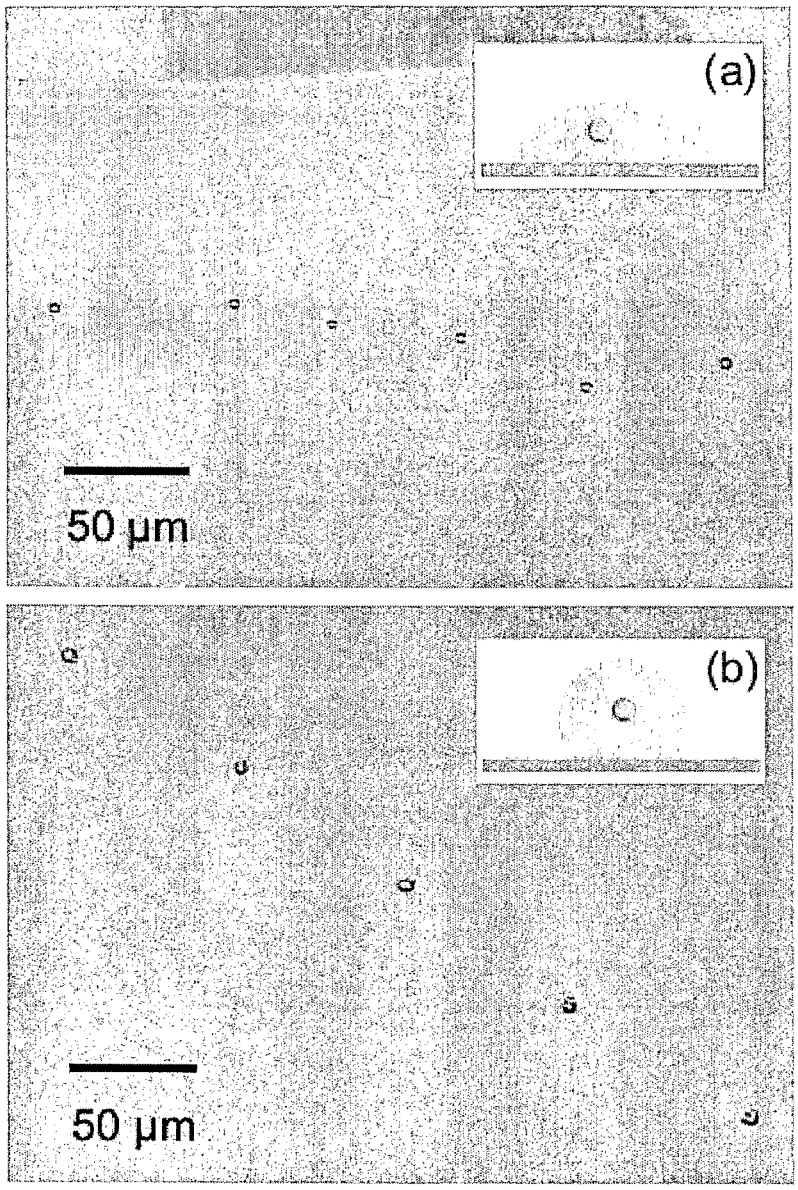
Figure 25: Improved positioning accuracy on a less wettable surface.

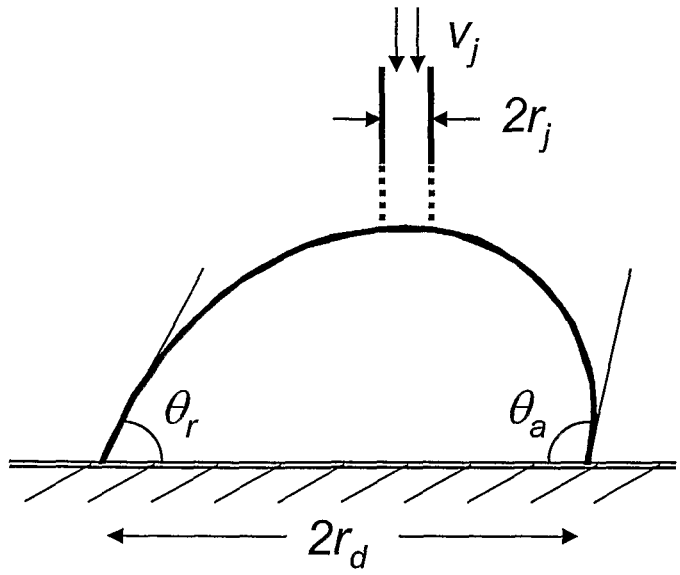
Figure 26: Drop formed by jet accumulation on a substrate.

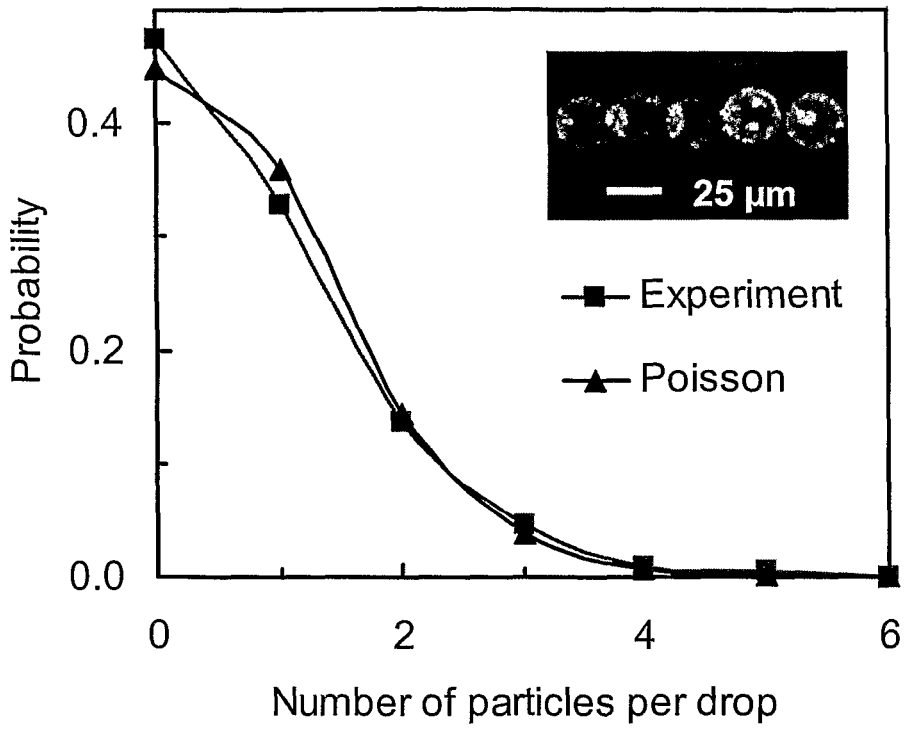
Figure 27: Poisson statistics of EHD drop-and-place.

ELECTROHYDRODYNAMIC PRINTING AND MANUFACTURING

This invention was made with government support under Contract No. W911NF-05-1-0180 awarded by the U.S. Army/Army Research Office (DARPA) and under Contract No. NCC-1-02037/LAR 17228-1 awarded by NASA-Langley Research Center. The government has certain rights in the invention.

BACKGROUND OF THE INVENTION

1. Field of the Invention

The present invention relates to electrohydrodynamic printing and manufacturing techniques and their application in liquid drop/particle and fiber production, colloidal deployment and assembly, and composite materials processing.

2. Discussion of the Background

Processing and conversion of micro- and nano-structural building blocks such as particles and fibers into composite materials and functional devices is essential for practical applications of micro and nanotechnology. Bottoms-up and top-down paradigms are complementary in their accessible length scales. However, contemporary techniques for fabricating microscale structures usually emphasize one aspect only, for example, self assembly covers the nanometer-scale from the bottom-up; pick-and-place covers the micrometer-scale from the top-down. Electrohydrodynamic (EHD) printing is a new paradigm for micro- and nano-manufacturing that can be used in two distinct modes to deploy either jets or drops onto surfaces. This EHD approach takes advantage of the large neck-down ratio of the cone-jet transition, which enables the production of nano- to micron-scale jets and/or drops from millimeter-scale nozzles and thus eliminates the nozzle clogging problem. Since the solutions used to create the jets and/or the drops can be self-assembling systems, these deployment techniques integrate the merits of both pick-and-place and self assembly into a single operation. The idea is to deploy liquid drops or jets containing self-assemblying particles to patterned locations through colloidal jets and/or drops and utilize these as building blocks for complex structures.

Using EHD printing, micro and nanostructures can be built through either one and/or combination of the following procedures:

i. Fiber by fiber by deploying liquid jets (e.g., structural nanocomposites);
ii. Particle by particle by deploying one particle per drop (e.g. photonic waveguide);
iii. Self assembly within the deployed fibers or drops (e.g. self-healing ceramic thermal insulation foam).

Compared to contemporary manufacturing techniques, the EHD printing technique is unique in that it eliminates tedious and costly cleanroom processes using the cone-jet transition and facilitates self assembly by carrying colloidal particles within EHD suspensions.

In fiber production, electrospinning is also an application of electrohydrodynamic cone-jet transition which relies on EHD whipping instabilities to stretch the electrified jets to produce thin polymeric fibers. These whipping instabilities lead to poor control of fiber orientation and usually result in polymeric mats with randomly oriented fibers. Although conventionally electrospinning is used to produce a very high surface area mat of randomly distributed fibers, which is used in applications such as filtering, protective clothing and tissue scaffolding; recently, there have been numerous techniques proposed to orient electrospun fibers by modifying the collector, which also works as a counter electrode. Two categories of collector modification are reported: (i) changing the shape of counter electrodes and direct the polymeric fiber along the direction of electric field; reported shapes include ring, edge, frame and parallel-strips; (ii) rotating the collector and deposit the polymeric fiber along the direction of rotation; reported configurations include rotating drum and plate. Although parallel or crossed line patterns can be achieved, these methods cannot be applied to more complex patterns. For complex pattern formation, the impingement of the filament to the target point should be controlled with high accuracy and precision.

A few electrospinning studies suggest using electrode separations smaller than conventional separations used in electrospinning. Natarajan et al. used 1-3 cm electrode separations together with point like bottom electrode to achieve aligned fibers. Craighead et al. produced aligned nano fibers on conducting/non-conducting striped substrates using 1 cm electrode separation. Although these authors used small electrode separations, they did not pay attention to the stability of the EHD filament. The main concern of these authors regarding electrode separation was solvent evaporation rather than stability. They avoided separations shorter than 1 cm. because membrane formation was observed for shorter separations rather than fiber formation. That they obtain a membrane and not linear patterns on a moving substrate is an indication of unstable nature of the EHD filament in their system. Because there is no set electrode separation for obtaining a straight and intact filament; oscillations of the filament may set in at separations as low as a few millimeters. In fact, Craighead and coworkers also reported that deposited fibers were not straight unless the rotary table speed is larger than a critical value, which suggests that at their operating conditions the filament was oscillatory.

In drop production, pulsed EHD jetting may be the only drop generation technique that can produce drops on-demand with dimensions a decade or so smaller than the nozzle. Although 'on-demand' drops are readily produced by an external voltage pulse, the large neck-down ratio derives from the EHD cone-jet transition which is fundamental to electrospray ionization. EHD cone-jets pulsate in response to intrinsic processes or external stimuli. Two intrinsic pulsating modes can arise due to the imbalance between the supply and loss of liquid in the entire cone volume (low frequencies) or in the cone's apex (high frequency). Externally pulsed electrosprays achieve higher sensitivity and better signal-to-noise ratio compared to the steady counterpart. Externally pulsed cone-jets were also exploited by to generate pico- to femtoliter droplets.

Contemporary techniques for particle deployment can be roughly classified as robotic, lithography-directed, and field-directed. Robotic manipulation is accomplished using MEMS effectors for pick-and-place or scanning probes like AFM tips; this category offers direct manipulation at nanoscale but has contact contamination and low throughput. Lithography-directed manipulation uses microfabricated patterns to guide particle deployment; this category offers batch manipulation but spatial resolution is limited and the technique is somewhat inflexibile due to the use of fixed lithographic patterns. Field-directed manipulation relies on field gradients to trap and move objects (e.g., optical tweezers); this category offers non-intrusive manipulation but the type of particle and operating environments are restricted. The EHD line printing and/or drop-and-place techniques aim at deploying particles via colloidal jets and/or droplets. EHD drop-and-place and fiber deployment can circumvent the aforementioned drawbacks and achieve flexible, non-contact manipulation of a variety of materials at relatively high precision (sub-micron) and high speed (kilo-Hertz).

SUMMARY OF THE INVENTION

EHD filaments emitted from Taylor cones are subject to surface tension or charge driven instabilities which result in breaking up of the filament into small droplets (spraying) or whipping of the filament (spinning). In this work, the operating conditions, especially the electrode separation, are manipulated to obtain an EHD filament that is stable (i.e., that does not break up or whip) and reaches directly to the opposite electrode.

In one part of the work, stable jet configuration is achieved for homogeneous liquids, polymeric solutions as well as colloidal suspensions. Typically, diameters are in the micrometer range and the aspect ratios are on the order of hundreds. The axis of the filament coincides with the axis of the nozzle and our experiments show that maximum deflections of the filament from this configuration are at most a few diameters.

In another part of the work, intact and straight EHD filament is used like a pen on a continuously moving substrate with respect to the nozzle. By this method, continuous polymeric and/or composite 'linear' patterns are produced on the substrate. The patterns that are deployed on a surface either solidify quickly to form a continuous fiber or break up into droplets before solidification to form discrete patterns.

In another part of the work, EHD filament is used to accumulate droplets on a stationary substrate. Droplets are produced on demand at a precise location with a precisely control amount of liquid. Arrays of droplets are produced by moving the substrate or the nozzle. Micrometer-level positioning accuracy is achieved by gradual EHD jet accumulation on a hydrophobic surface.

In yet another part of the work, top-down EHD printing technique is used in combination with bottom-up colloidal self assembly. When the patterning liquid is a colloidal and/or polymeric suspension, self assembly of colloidal particles leads to 2D colloidal crystals, 3D colloidal aggregates, or polymeric composite fibers with aligned anisotropic particles and conductive fillers.

BRIEF DESCRIPTION OF THE DRAWINGS

FIG. 1 illustrates setup for stability experiments.

FIG. 2 illustrates the stability difference resulting from electrode separation difference.

FIG. 3 shows maximum deflection of the filament from its centerline as a function of filament length at constant electric field, and volumetric flow rate.

FIG. 4 shows variation of the straight section of the EHD filament as a function of volumetric flow rate at constant electrode separation and electric field.

FIG. 5 illustrates the setup for EHD printing of polymer fiber.

FIG. 6. shows EHD printed polymer fiber of 100 nm diameter.

FIG. 7 demonstrates the effects of mechanical stretching on fiber diameter.

FIG. 8 shows effect of electric field on fiber diameter.

FIG. 9 shows EHD printed polyethylene oxide fiber mat.

FIG. 10 shows the fiber produced from a conductive polymer.

FIG. 11 shows almost perfectly crystalline linear arrays of microspheres produced by EHD printing and illustrates the self assembly mechanism.

FIG. 12 shows the alignment of rod-like particles in EHD polymeric fiber.

FIG. 13 demonstrates alignment of anisotropic particle by EHD printing (a, b) and by mechanical stretching (c, d).

FIG. 14 shows patterns produced by EHD printing on a hydrophobic surface.

FIG. 15 illustrates 3D colloidal crystal formation after filament deployment.

FIG. 16 shows the most common structures of colloidal aggregates composed of different number of polystyrene particles per cluster.

FIG. 17 shows patterns produced by EHD printing on a hydrophilic/hydrophobic pre-patterned surface.

FIG. 18 illustrates experimental setup for pulsed EHD drop generation.

FIG. 19 shows EHD drop generation process.

FIG. 20 shows flow rate of drop formation supporting $Q \sim d^4E^2L^{-1}$ scaling law.

FIG. 21 illustrates analogy of transient cone jets on (a) a supported meniscus and (b) an exploding drop.

FIG. 22 shows current measurement in the EHD circuit.

FIG. 23 shows frequency of intrinsic pulsation as a function of applied voltage.

FIG. 24 shows drop array produced by a pulsed EHD jet.

FIG. 25 shows improved positioning accuracy on a less wettable surface.

FIG. 26 illustrates a drop formed by jet accumulation on a substrate.

FIG. 27 shows Poisson statistics of EHD drop-and-place.

DETAILED DESCRIPTION OF THE PREFERRED EMBODIMENTS

The precision of patterning with EHD filaments is dictated by the amount of deflections of the liquid filament from its centerline position. Therefore, spatial stability of EHD filament is a necessary condition for printing.

After leaving the cone, EHD filament is subject to both axisymmetric and non-axisymmetric disturbances. Free charge on the filament coming from charge separation within the Taylor cone, and the competition between surface stresses makes EHD filament unstable to both axisymmetric and non-axisymmetric disturbances. Typically for high viscosity polymeric mixtures, non-axisymmetric disturbances grow much faster than the axisymmetric ones, therefore the observed phenomenon is whipping. Our experiments showed that lengths of the straight and intact EHD filaments are much larger than the lengths estimated from the theories developed for stability of EHD jets.

Parameters, such as electric field strength, radius of the filament, and physical properties of the liquid affect the stability of charged filaments of liquids under electric field. In the following paragraphs it will be shown that in addition to these parameters, stability of EHD is a strong function of the electrode separation or the length of the liquid filament as well.

We use the equipment shown in FIG. 1 for the stability experiments. Stainless steel 13×13 cm parallel plate electrodes (1 and 2) are used to keep the applied electric field uniform. A stainless steel nozzle having 640 μm diameter sits on the top electrode and protrudes 2 mm from the surface (4). In order to avoid the liquid accumulation, a 15 mm diameter pool (5) is located at the center of the bottom electrode. Liquid is pumped through teflon tubing both into (3) the nozzle and out (6) from of the pool at the same rate. Electrode separation is adjusted by a lab jack (8) on which the bottom electrode is attached by insulating legs (7). High voltage (10) and ground (9) electrical connections are made through screws that are on the outer faces of the electrodes, to avoid electrical disturbances to the system. A 10,000 fps CCD camera (Redlake MotionPro, San Diego, Calif.) with a long-distance microscope (Infinity K2, Boulder, Colo.) sit on a vertical translation stage with a digital reader.

Before starting the experiments, the upper and lower electrodes are positioned such that needle is centered to the hole on the bottom electrode. Electrode separation is adjusted and measured by a micrometer. Liquid is fed to the nozzle and drained from the reservoir below the pool by a dual syringe pump (Harvard 33 Twin Syringe Pump, Harvard Apparatus, Holliston, Mass.). This way liquid level is kept same as the electrode surface and uncertainty in the electrode separation arising from unknown level of accumulated liquid is avoided. Upon application of sufficiently high potentials (High voltage supply: Model 620A, Trek Inc., Beaverton, Oreg.) typically on the order of 1-6 kV, a thin filament is emitted from the tip of the cone. Current is monitored via an electrometer (Model 6514, Keithley, Cleveland, Ohio) connected to the computer by RS232. The position of the optical system is adjusted to a location to visualize the desired section of the EHD filament.

Representative images of two EHD filaments formed at (a) 6.5 mm and (b) 38.5 mm electrode separation are shown in FIG. 2. In this experiment flow rate is 1 ml/h and applied electric field between the parallel plate electrodes is 5180 V/cm for both (a) and (b). Liquid used in the experiment is a polymeric mixture containing a 2.67 weight % PEO (200 kDa molecular weight) dissolved in a 1:1 by volume water and ethanol at 5180, doped with KCl to raise its conductivity to 660 μS/cm. The short filament (FIG. 2*a*) reaches the opposite electrode without any significant oscillation, whereas the long filament (FIG. 2*b*) moves back and forth. The experiment shows that under the same operating conditions, small electrode separation results in an improved control over the spatial deflections of the EHD filaments.

FIG. 3*a* shows the quantitative comparison of centerline deflection of a long and short EHD filament at the same position from the nozzle under 1 ml/h flow rate and 4100 V/cm electric field. To ensure that behavior of the filaments is well represented by the data, sequence of 150 images of PEO (300 kDa molecular weight) filaments is captured for each experiment. Images are analyzed to determine maximum deflection of the filaments from their stable position. Maximum deflection of the filament refers to the largest horizontal length scanned by the filament within the captured images.

In FIG. 3*a*, the data points represented by green correspond to the short filament configuration and give the maximum deflection of the filaments at the point where they reach the bottom electrode. Both deflection data and filament length are normalized with respect to filament diameter. Therefore, filament length shown in x-axis represents the aspect ratio for these points. Data points represented by blue, however, refer to the deflections of a long EHD filament at positions given by x-axis. This allows comparison of the short and long filaments exactly at the same position along their length. The bottom electrode for the blue data points was fixed at 722 diameters away. Different symbols correspond to repetition of the same experiments at different days.

FIG. 3*b* shows the average of absolute value of deflections for glycerol filaments at two different electrode separations, 8.7 and 17.4 mm along their length. Similar to the experiments shown in FIG. 3*a*, volumetric flow rate and electric field are kept constant (at 12 ml/h and 943 V/mm respectively). 150 images of the filament are captured at the same camera position in each electrode separation and analyzed for their deflections from vertical using a Matlab program. The upper lines show the deflections of large separation filament, whereas the lower lines show the deflections of small separation filament. Different colored lines correspond to repetitions of the same experiments.

Results from both glycerol and PEO experiments given in FIG. 3 show that electrode separation can play a significant role in controlling the stability of EHD filaments and smaller electrode separations (shorter filaments) can reduce the deflection of the EHD filaments up to one order of magnitude. The EHD printing is done under small electrode separations in order to improve the stability of the EHD filament and hence the positioning accuracy of the printing.

Lacking of an adequate theory for estimating the required electrode separation to obtain a straight EHD filament, the required electrode separations are determined experimentally before doing any printing. In order to get insight about how to manipulate operating conditions other than electrode separation, experiments are done at a constant electrode separation. FIG. 4 shows the variation of the straight length of glycerol filaments having three different conductivities (6.27, 8.97 and 29.8 μS/cm) at 2 cm electrode separation and 16 kV applied potential. In these experiments volumetric flow rate varies between 0.1 to 15 ml/h. In the plot shown in FIG. 4, intact length is non-dimensionalized with respect to the measured filament diameter and volumetric flow rate is non-dimensionalized using a flow rate scale based on the physical properties of the liquid, namely surface tension ($\gamma$), dielectric constant ($\in$), density ($\rho$) and conductivity (K). These experiments demonstrate that at constant separation, decreasing volumetric flow rate is a good strategy to increase the length of the EHD filament as well as to decrease the diameter of the filament. The strategy related to conductivity is not straightforward since increasing the conductivity allows thinner filaments but at the same time decreases the length of the EHD filament.

For patterning purposes it is important to have sufficient separation between the two electrodes, especially when patterning large areas where the variation to surface flatness can be large. Our experiments show that EHD filaments as long as several millimeters are feasible if the right conditions are met.

The experimental set up for printing is shown in FIG. 5. A polymeric solution or suspension is supplied to the metal needle by a syringe pump. High voltage is applied between the needle and a counter electrode. A rotating table is used to collect the fiber. Alternatively, fibers can also be collected on conductive/non-conductive surfaces attached to the rotating table.

Patterns less than 10 μm can be produced routinely and under appropriate conditions feature sizes can be in the nanometer scale. FIG. 6 shows the TEM image of 100 nm PEO fibers EHD printed from 3.75 wt % solution (in ethanol-water mixture). Fibers in this figure are printed directly on a carbon coated TEM grid in an almost parallel fashion.

The diameter of the printed structure is controlled by decreasing the volumetric flow rate, increasing the conductivity, decreasing the non-volatile content, and increasing the hydrophobicity of the substrate. Alternative is, especially for polymeric mixtures, stretching the filament with the help of high table speeds. This additional stretching allows production of fibers having comparable thicknesses to the electrospun fibers, which are thinned down due to stretching during the whipping motion. FIG. 7 shows the effects of mechanical stretching on the fiber diameter. When other experimental conditions are kept the same (voltage=4.5 kV, separation=1.0 cm, flow rate=0.01 ml/h, nozzle diameter=260 um, PEO: 1% wt in 1:1 water:ethanol), a high speed of the turn table leads to stronger mechanical stretching and therefore fibers with smaller cross section. FIG. 8 shows that when other experimental conditions are kept the same (PEO: 2% wt in 1:1 water:ethanol, separation=1.0 cm, table speed=1.1 m/s, flow rate=0.01 ml/h, nozzle diameter=260 um), a higher electric field results in a larger diameter because higher electric stress acts against mechanical stretching and reduces its effects.

EHD printing method is used to produce pure polymeric as well as composite patterns. FIG. 9 shows EHD printed fiber mat made off (a) polyethylene oxide (PEO) (2 wt % PEO in 1:1 water:ethanol, MW=4,000 kDa). (b) carbon nanotube (CNT) filled polyimide (1% wt single walled carbon nanotube, 20% wt polyimide in Dimethyl acetamide (DMAc)). FIG. 10. shows an EHD printed conductive polymer (PEO-PPO-PEO surfactant (F127): 4 mg/ml; and polyethylene oxide (PEO): 8 mg/ml) containing (4 mg/ml) thermally exfoliated graphite oxide (TEGO). The resulting conductivity is 0.06 S/m.

EHD printing of colloidal suspensions results in almost perfectly crystalline linear arrays. FIG. 11*a* shows the patterns produced by printing 2 μm PS latex particles on a glass substrate. The bottom image depicts a typical section of a one dimensional colloidal array. After printing of the colloidal suspension on the glass substrate, pinning of the contact line and evaporation of solvent generates an internal flow from the center of the filament towards the contact lines within the deployed filament. Particles are carried to the contact lines by this flow and start to accumulate along the contact lines similar to the coffee particles in an evaporating coffee droplet (FIG. 11*b*). The acute contact angle immobilizes the particles near the contact line region. After the liquid level is decreased below the height of a single particle, the meniscus between particles is deformed; resulting in attractive capillary forces between the opposite sides of the contact line (FIG. 11*c*). In order to bring the two sides of the contact line together (FIG. 11*d*), capillary forces have to overcome friction between the particles and the substrate. Because capillary forces get weaker as the separation between the particles get larger, the separation between the two sides of the contact line should be smaller than a critical value to achieve a pattern similar to the one shown in FIG. 11*a*.

When anisotropic particles are incorporated into the polymeric fiber, EHD printing technique can be used to align these particles. FIG. 12 shows an example of oriented rod-like particles in EHD printed polymeric composite fiber. The iron hydroxide (FeOOH) rods (6 um×0.2 um) are dispersed at 3.5 wt % in 2:3 ethanol:water; 10 mg/ml PEO were added as polymer matrix. The rods are oriented in the direction of the fiber after being deployed on a silicon substrate.

FIG. 13 suggests that mechanical stretching plays a significant role in aligning these rods. FIG. 13*a-b* shows alignment of anisotropic particle by EHD printing; and FIG. 13*c-d* shows alignment by pure mechanical stretching. The iron hydroxide (FeOOH) rods are 1.5×1.0 μm. The volumetric ratio of FeOOH to PEO is approximately 1:1. EHD printing: (a) turn table at 1 rps (linear speed ~0.6 m/s); (b) turn table at 2 rps (linear speed ~1.2 m/s); other conditions for (a) and (b) are the same. With higher stretching rate at 2 rps (b), the fiber is stretched longer and suspended in the air for longer; the composite fiber is dry when reaching the substrate, as opposed to 1 rps (a) where the solvent is not completely evaporated and the fiber is wet. Mechanical stretching: the polymeric rod suspension is laid down the substrate by dipping a pipette tip and mechanically stretching the polymeric suspension. Fiber in (d) is suspended in air for longer than (c), and the fiber was dried before reaching the substrate. The fact that mechanical stretching can lead to similar patterns in rod alignment suggests that polymer stretching plays a significant role in rode alignment by EHD printing.

When the filament is composed of polymer dissolved in a volatile solvent, unless the solvent is very volatile or the filament is in nanometer scale, majority of the solvent evaporation occurs after the filament is deployed on the surface. The pre-dried pattern on the surface may develop a rivulet instability which causes the pattern to break up into 'islands'. It is known that if the contact lines are parallel and fixed, inviscid liquid filaments on a surface are stable when the contact angle is less than 90°. When the substrate is hydrophobic and the contact lines are not pinned, the deployed filament is always unstable and expected to break up. However, in our case there are volatile solvents and as the liquid evaporates, volume, dimensions and viscosity of the filament changes. Under fast evaporation, even unstable filaments can be 'frozen' before the disturbances grow, if the evaporation is much faster than the instability growth. If the evaporation time is much longer than the instability growth time, discrete patterns are expected as a result of 'printing' on a hydrophobic surface.

Surfaces of the substrates used for patterns shown in FIGS. 14*a*, 14*b*, 14*c*, 17*a* and 17*b* are modified using 2 mM and 1-hexadecanethiol and 1 mM 16-mercaptohexadecanoic acid solutions in ethanol. For uniform coverage (FIGS. 14*a*, 14*b*, 14*c*), the gold coated silica surfaces are covered with hydrophobic solution via a cotton swab, whereas the patterning (FIGS. 17*a* and 17*b*) is achieved by stamping the hydrophilic solution and then dipping the substrate to the hydrophobic solution followed by washing with ethanol. PDMS stamps with line widths 2, 4, and 8 μm are used.

The pattern shown in FIG. 14*a* is produced by deploying a filament that is composed of 95% glycerol and 5% water on a hexadecanethiol coated hydrophobic surface. Because of the low vapor pressure of glycerol the evaporation rate of the liquid is very low. Therefore, after the filament is deployed on the moving surface, rivulet instability takes over. The filaments break up into droplets and the separations of between the droplets are dictated by the fastest growing wavelength of the rivulet instability. Because of the 'stable' nature of the EHD filament, uniform patterns over large areas can be obtained consistently as demonstrated in FIG. 14*a*.

When a colloidal suspension of 5.7 μm latex particles (15.6% particles, 71% water and 13% ethanol by volume and 0.085 g/L PEO 300 kDa) is printed on a 1-hexadecanethiol coated (hydrophobic) gold surface, unique 3D clusters are formed. FIGS. 14*b* and 14*c* shows the patterned substrate at different magnifications. The inset shown in FIG. 14*b* shows the details of the 3D cluster formed by self assembly. As explained above, the filament breaks into droplets due to the hydrophobicity of the surface almost instantaneously after the deployment. The break up on the surface is four orders of magnitude faster than the evaporation. The number of particles per droplet follows a Poisson distribution, and depends on the average concentration of the suspension.

FIG. 15 illustrates the self-assembly of colloidal particles to 3D clusters after the printed line broke into droplets. The contact lines are not fixed and there is no reason to expect a significant circulating flow inside the droplet. As the evaporation proceeds, droplet shrinks, and instead of ring formation, the particles are confined in a smaller and smaller volume (FIG. 15*a*). Our particles are electrostatically stabilized therefore they do not coagulate during the shrinking period. Shrinking of the droplet forces some particles to protrude out of the droplet (FIG. 15*b*). This causes the interface between the particles to be deformed, resulting in capillary forces which are many orders of magnitude larger than rest of the forces, such as electrostatic or van der Waals forces. Capillary forces pull the particles closer to each other eventually forming the 3D cluster as shown in FIG. 15*c*.

FIG. 7 shows the most common structures formed as a result of self-assembly of 5.7 μm polystyrene particles on a hydrophobic thiol coated gold surface after EHD printing of a polystyrene suspension which contains 2.5 times less particles compared to the mixture used for pattern in FIG. 14*a*. FIG. 16 shows that the packing of the particles are dependent on the number of particles. The structures (except the two and three particle cases) are different than the ones that are reported to form as a result of evaporation from a fully spherical droplet, due to the existence of the substrate which breaks the spherical symmetry. The configuration of the particles is such that it will minimize the total surface free energies for the particular volume of the liquid left at that stage of evaporation. The substrate-liquid and substrate-air interfacial energies are also a part of the total energy of the system, and magnitudes of these also create differences in the final colloidal structure compared to a substrate-free droplet.

When the surface is decorated by hydrophilic (16-mercaptohexanoic acid) and hydrophobic (1-hexadecanethiol) thiol groups, patterns having shapes different than circular can be produced (FIGS. 17*a* and 17*b*). In this case, linear thiol patterns are used and EHD printing is done in directions not parallel to them. Hence the deployed filament sits on both hydrophobic and hydrophilic regions along its length. The filament breaks up in the hydrophobic regions and liquid is pushed to hydrophilic regions, where the filament is stable. This results in discrete patterns width and length of which are functions of the widths of the deployed filament and the hydrophilic region respectively. Separation between each pattern and the angle of the pattern are controlled by the width of the hydrophobic lines and the angle of EHD printing with respect to the thiol lines. Varying the dimensions of the filament, thiol patterns and the angle of printing results in rich variety of patterns. FIG. 8*a* shows a pattern as a result of deploying a high molecular weight (4000 kDa) PEO mixture without glycerol. Lower volatility and higher viscosity results in incomplete break up. The patterns shown in FIG. 8*b* is formed by deploying PEO (300 kDa)/ethanol/water mixture with trace amounts of glycerol to suppress the evaporation rate and guarantee the break up.

FIG. 19 is a schematic representation of the drop and place experimental setup. A thin teflon tube is used as the nozzle to carry liquid for EHD drop generation. The teflon nozzle was 360 μm-OD and 50 μm-ID unless otherwise specified (Upchurch 1930, Oak Harbor, Wash.). Inner diameters of 75 μm and 100 μm were also used to test the scaling laws. The teflon nozzle was connected to a liquid reservoir through a 0.97 mm-ID polymeric tube (Hamilton 90619, Reno, Nev.). The working fluid was deionized water and was left to equilibrate in atmospheric condition for 24 h to ensure reproducible conductivity. The conductivity of deionized water equilibrated in atmosphere was measured to be $0.9\times10^{-4}$ S/m. The sealing of liquid path was assisted by a stainless steel union (Upchurch U-437) together with tubing sleeves (F-242) and fittings (F-120). The liquid reservoir was held at a constant height during the experiments (0.05-0.25 m above the nozzle) and was selected to approximately balance surface tension to achieve a 'flat' meniscus, i.e., a condition at which the teflon nozzle remained filled but no liquid protruded from the nozzle by visual inspection. In addition to being thin and insulating which are respectively important for reducing flow rate and preventing corona discharge, the teflon nozzles used here are hydrophobic which restrict liquid wetting to the inner nozzle and ensure a repeatable conical base for reproducible cone-jet transitions.

For particle deployment, the silicon substrates are either coated with chrome (contact angle θ~30°), or gold and treated with 1-hexadecanethiol (Sigma-Aldrich CAS #2917-26-2), a hydrophobic reagent (θ~100°). Each external voltage pulse produces a drop and for multiple drop production, the nozzle is mounted on a custom-built motion system with a single-shaft stepping motor (MicroLynx-4; Intelligent Motion Systems, Marlborough, Conn.). Sulfate latex spheres (2.0 μm diameter, Interfacial Dynamics 1-2000) are dispersed at a weight concentration of $8.0\times10^{-5}$ (w/w) in deionized water with a conductivity of $0.9\times10^{-4}$ S/m. In certain experiments, red fluorescent dye (28 nm spheres, Duke Scientific R25) is added at $1.0\times10^{-4}$ (W/W) to trace the deployed drops.

A high voltage pulse was applied between the teflon nozzle (through the stainless union) and a silicon substrate using a pulse generator (HP 811A, Palo Alto, Calif.) and a high voltage amplifier (Trek 20/20C, Medina, N.Y.); each external voltage pulse produced a drop on the substrate. The nozzle was grounded and the silicon substrate negatively electrified. The pulsed jetting process was monitored by a 10,000 fps CCD camera (Redlake MotionPro, San Diego, Calif.) using a long-distance microscope (Infinity K2, Boulder, Colo.) at a magnification of 6.6×. The current in the EHD circuit was measured by the voltage drop on an oscilloscope connected between the nozzle and ground. The 300 MHz oscilloscope (Tektronix 2440, Beaverton, Oreg.) has a capacitance of 15 pF and a standard resistance of 1 MΩ.

We show microscopic imaging of a typical process for EHD drop generation in FIG. 19*a*. An external voltage pulse of 20 ms duration is applied to deionized water within a 50 μm-ID teflon nozzle, and the camera is triggered upon the rising edge of the pulse. The drop formation process appears steady with a camera frame rate of 2,500 fps and exposure time of 394 μs. The mirror images on the silicon substrate are also included to clearly show the conical structure. Initially, the pressure head is adjusted such that the static liquid meniscus is almost flat at the nozzle exit. When an external voltage pulse is applied, the liquid meniscus gradually deforms into a Taylor cone, and eventually a jet is emitted (at 3.6 ms). The water jet is collected on a silicon substrate as a series of drops. The volume of a collected drop is proportional to the pulse duration minus the time delay to form a Taylor cone (3.6 ms for the present case). At the end of the 20 ms pulse, EHD jetting stops and the conical shape gradually relaxes back to the original state without electric stress (at 22.8 ms).

FIG. 19*b* shows that the cone and drop formation rates extracted from FIG. 2*a* are approximately equal which is also true under a variety of conditions. This empirical equivalence suggests that the flow rate is drag-limited, i.e., the drop formation rate is not determined by the EHD process, but by the balance between electric stress at the liquid/air interface and the viscous drag in the thin nozzle. As a result, the drop formation rate Q can be estimated as the cone formation rate $Q_c$, which is governed by the Poiseuille-flow solution for low-Reynolds number flow, $$Q \approx Q_c \sim \frac{\pi d_n^4}{128\mu L}\left(\frac{\varepsilon_0 E_0^2}{2} - \frac{2\gamma}{d_n} + P\right), \tag{1}$$

where μ is the viscosity of the liquid, $d_n$ and L are the inner diameter and length of the nozzle, $E_0$ is the scale for external electric field, γ is the surface tension of the air/liquid interface, P is the hydrostatic pressure with respect to the nozzle exit. In Eq. (1), the scales of electric pressure ($\in_0 E_0^2/2$), capillary pressure ($2\gamma/d_n$) are lumped with hydrostatic pressure (P) to drive flow through the thin nozzle. Further, data on conical volume vs. Time (FIG. 19*b*) can be used to eliminate the uncertainty introduced by the pressure head and surface tension. Equation (1) can be rewritten as $$Q_c+Q_{c,r}\sim\pi d_n^4\in_0 E_0^2/(256\,\mu L), \tag{2}$$

where $Q_{c,r}$ is the rate at which the Taylor cone retracts due to surface tension.

This scaling of flow rate is shown in FIG. 20 which presents drop formation rates with nozzles of three different inner diameters as a function of increasing voltage. Flow rate of drop formation supporting $Q\sim Q_c\sim d^4E^2L^{-1}$ scaling law. Teflon nozzles of three different inner diameters (d) are used with the following length (L) and nozzle-to-collector separation (S): ●: d=50 μm, L=30 mm, S=110 μm; ■: d=75 μm, L=41 mm, S=140 μm; ▲: d=100 μm, L=41 mm, S=230 μm. The nominal electric field ($\bar{E}$) is voltage over separation, where voltage is varied between 1.2 and 2.0 kV. The solid line is a linear regression fit to the flow rate of 75 μm-ID nozzle with a $R^2$ constant of 0.991. The dashed lines are linear fits to the 50 μm- and 100 μm-ID nozzles, respectively, with a slope equal to that of the solid line. From Eq. (1), flow rate should scale as $Q\sim d^4E^2L^{-1}$ which is supported by FIG. 20 where the nominal electric field was taken as applied voltage divided by the nozzle-to-collector separation ($\bar{E}$=V/S). The proportionality constants for all three different nozzle sizes are identical to within experimental uncertainty. Furthermore, the experimental proportionality constant is comparable to the theoretical prediction. Experimentally, the proportionality constant $(Q_c+Q_{c,r})/(d^4V^2S^{-2}L^{-1})$ is $3.6\times10^{-10}\ m^2s^{-1}V^{-2}$; very close to the theoretical value, $\pi\in_0/256\mu=1.1\times10^{-10}\ m^2s^{-1}V^{-2}$. The mismatch is readily explained by the fact that the electric field at the nozzle exit is higher than the nominal electric field.

Although the drop generation process depicted in FIG. 18 appears steady, the cone-jet transition has an intrinsic pulsation. The apparent steadiness is a result of the long integration time (0.4 ms) of the CCD camera; when the exposure time was reduced to 0.1 ms or less, intrinsic pulsations in the kilo-Hertz range were observed. In a drag-limited system, the flow rate that the EHD cone-jet can accommodate is larger than the rate at which liquid can pass through the thin nozzle; this imbalance between the loss and supply rates leads to intrinsic pulsations. Both low-frequency (order of 10 Hz) and high-frequency (~1 kHz) pulsation modes are reported for an EHD configuration under a constant, externally-pumped flow rate. The low-frequency mode is related to the depletion and filling of the cone and is not observed in our system where the flow rate is self-regulated. Instead, the cone volume remains approximately constant after the cone is initially filled (as shown in FIG. 19), and the intrinsic pulsations correspond to the high-frequency mode due to the mass imbalance at the cone apex.

As shown in FIG. 21*a*, when the liquid at the nozzle exit is electrified by an external field, free charge accumulates at the liquid/air interface and the associated electric stress pulls a thin jet out of the deformed interface. The cone-jet transition on the supported meniscus is analogous to that on an isolated, charged drop shown in FIG. 4*b*. Without any external field, when a charged drop reaches the electrostatic (Rayleigh) stability limit, transient cone-jets develop in order to redistribute the charge to a larger surface area. The cone-jets on a supported meniscus and an exploding drop have comparable characteristics under the following conditions:

- Both cone-jets are quasi-steady, i.e., the lifetime of a (transient) cone-jet is much longer than the charge relaxation time ($\tau_e$).
- Both emitted jets are thin, i.e., the jet diameter is much smaller than the nozzle/drop diameter ($d_j \square d_n, d_d$).
- Both conical bases have comparable dimension, i.e., the nozzle and drop diameters are approximately equal ($d_n \approx d_d$).

The intrinsic pulsation in our system is analogous to the transient cone-jet pulsation experienced by an isolated, charged drop undergoing electrostatic Rayleigh fission. This is an extension of a far-reaching analogy between the transient cone-jet on an exploding drop due to excessive surface charge and the steady cone-jet on a supported meniscus under external electric field. Physically, the cone-jet transition develops when the surface charge accumulates to a level where the charge has to be redistributed to a larger surface area in order to reach a new electrostatic equilibrium; the rate at which surface charge is accumulated and ejected determines whether the cone-jet is transient or steady. As long as the cone-jet is quasi-steady, i.e., its lifetime is long compared to the time scale of charge redistribution, the characteristics of all three types of cone-jets should be comparable. With this assumption, the scaling laws of other cone-jets can be applied to our system with intrinsically pulsating cone-jets. For a 'high-conductivity' liquid ($\geq10^{-5}$ S/m), the flow rate, jet diameter, and life time of an intrinsically pulsation cone-jet scale as:

$$Q_m\sim\gamma\tau_e/\rho, \tag{3}$$

$$d_m\sim(\gamma\tau_e^2/\rho)^{1/3}, \tag{4}$$

$$\Delta t_{j,m}\sim(d_n/d_m)^{3/2}\tau_e, \tag{5}$$

where subscript $_m$ denotes a scaling variable, $\gamma$ is the surface tension, $\rho$ the liquid density; $\tau_e$ is the charge relaxation time defined as $\tau_e=\in\in_0/K$, where $\in$ and K is the dielectric constant and conductivity of the working liquid, and $\in_0$ is the permittivity of vacuum. Based on these scaling laws, one pulsation cycle extracts a volume of liquid, $V_{pj}$, from the cone, $$V_{pj}\cdot Q_m\Delta t_{j,m}\sim(d_nd_m)^{3/2}, \tag{6}$$

and the intrinsic pulsation frequency scales as, $$f_{pj}\sim\frac{Q}{V_{pj}}\sim\frac{Q_c}{(d_nd_m)^{3/2}}\sim\frac{KE^2}{\varepsilon\mu L}\left(\frac{\rho d_n^5}{\gamma}\right)^{1/2}. \tag{7}$$

As a confirmation of the frequency measured by CCD imaging, FIG. 5 presents a sample measurement of the intrinsic pulsation frequency through the EHD current signal. Nozzle ID=50 μm, OD=360 μm, length=30 mm; Voltage=1.6 kV, nozzle-to-substrate separation=150 μm. The current is measured by an oscilloscope, with 512 data points sampled at 50 kHz. The current in the EHD circuit was measured by the voltage drop on a 1 MΩ oscilloscope. At a nominal electric field of 1.0 kV/cm, the Fourier transform of the EHD current peaks at 1.1 kHz, which corresponds to the frequency of intrinsic pulsation captured by the video imaging. The measured intrinsic pulsation frequency was typically in the lower kilo-Hertz range, comparable to those reported for water-organics mixture.

The validation of scaling law for intrinsic pulsations is shown in FIG. 23, which plots frequency of intrinsic pulsation as a function of applied voltage. The pulsation frequency was measured by video imaging at 10,000 fps with 94 μs exposure time and spot-checked by the current measurement described above. Conditions: d=50 μm, L=30 mm, S=110 μm. The error bar represents the maximum standard deviation of three independent measurements in the reported voltage range. The applied voltage was ramped up from 0 to 2 kV. The cone-jet transition onsets around 0.8 kV, and the pulsation frequency increases from below 1 kHz at 0.8 kV to above 5 kHz at 2 kV. Between 1.0 and 1.8 kV where non-aliased, reproducible data was obtained, the pulsation frequency was approximately a linear function of voltage squared which is consistent with scaling law (Eq. 7).

The scaling law for intrinsic pulsation is further supported by FIG. 19. The measured jet diameter ($d_m$) is 4±2 μm and the inner diameter of the nozzle ($d_n$) is 50 μm. The scaling law (Eq. 6) predicts that the drop diameter per pulsation $(d_n d_m)^{1/2}$ is 14±4 μm, which is consistent with the smallest drop diameter of approximately 10 μm (measured at 3.6 ms).

The scaling laws for intrinsic pulsation provide important design guidelines for EHD drop formation. The jet diameter scaling (Eq. 4) is a lower bound to the positioning accuracy of the drop. The volume per pulsation (Eq. 6) determines the smallest EHD drop. The pulsation frequency (Eq. 7) is an upper bound for the speed of drop generation. The scaling laws of EHD flow rates and cone-jet pulsations are also expected to be applicable to miniaturized electrospray provided the assumptions such as thin nozzle and high conductivity are properly satisfied.

FIG. 24 shows an array of drops produced by a pulsed EHD jet. An external voltage pulse leads to cone-jet transition of the electrified liquid meniscus, and produces a drop on the counter electrode (inset). The EHD drop formation process is highly reproducible as indicated by an array of fluorescent spots as drop residue after solvent evaporation. Electrical configuration: voltage=1.2 kV, nozzle-to-collector separation=140 μm, pulse duration=7.5 ms. The inset picture shows a sample cone-jet transition emitting from an electrified liquid meniscus. A single external voltage pulse typically produces one drop, enabling on-demand drop generation. The large neck-down ratio of the cone-jet transition enables production of micron and sub-micron jets without resorting to microfabricated nozzles, making EHD drop formation an ideal method to implement the drop-and-place idea. We previously reported a scaling analysis of pulsed EHD drop formation. This scaling analysis provides design guidelines such as drop volume and generation frequency of EHD drops. Despite the intrinsic pulsations resulting from the viscously-limited flow rate, we showed that the drop formation process appears steady for a sufficiently long (compared to the cycle of intrinsic pulsation) external pulse. The apparent steadiness is also supported by the array of fluorescent spots (residues after solvent evaporation) showing the reproducibility of the drop formation process.

Guided by these insights, we utilized pulsed EHD drops as a transport medium for colloidal particles. There are two major challenges in implementing drop-and-place of single colloids: (i) positioning accuracy, the ability to place particles precisely at a pre-determined location and (ii) dosing accuracy, the control over how many particles are sampled in each droplet. The scaling laws are important design guidelines: the accuracy of drop positioning is limited by the EHD jet diameter; the average number of particles dosed is related to particle concentration and drop volume. Here, we explore the possibility of delivering single particles at precise locations.

FIG. 25 shows that the positioning accuracy can be improved by tuning surface wettability. The substrates used: (a) Chrome-coated silicon substrate; (b) Gold-coated substrate treated with 1-hexadecanethiol, a hydrophobic reagent. Fluorescent dye is added to (b) to show the contact area between the colloidal drops and the substrate. Electrical configuration is same as FIG. 24. An array of 2 μm spheres was deployed via 52 μl colloidal drops (statistically one 2 μm-particle per drop), respectively, on a hydrophilic (θ~30°) and hydrophobic (θ~100°) substrates. By using a more hydrophobic surface, the positioning accuracy is improved by an order of magnitude (to approximately the 2 μm particle diameter). This positioning accuracy is comparable to the jet diameter of 4±2 μm. The order-of-magnitude improvement in positioning accuracy is achieved through elimination of contact line pinning and minimization of impingement-induced drop motion. On a hydrophilic surface, contact line pinning leads to the so-called "coffee-stain" pattern in which colloids deposit at the edge of the drop upon solvent evaporation; these pinning effects are reduced or eliminated on a hydrophobic surface. Since the contact area between the evaporating drop and hydrophobic surface is smaller, the drop residue on a hydrophobic surface is significantly smaller than a hydrophilic one. However, the outstanding positioning accuracy cannot be solely attributed to the hydrophobic surface. In fact, inkjet printing of polymer drops on a hydrophobic surface leads to "well-defined dots" (i.e. minimal drop residue) but poor positioning accuracy.

In addition to low surface wettability, restricted drop motion on the substrate is essential to achieving good positioning accuracy. In this respect, gradual drop formation by EHD jet accumulation is better than the abrupt drop detachment characteristic of inkjet printing, because the former introduces far less momentum to the drop. FIG. 26 shows a drop formed by jet accumulation. The jet of radius $r_j$ impinges on a drop at a velocity of $v_j$. The drop has a contact radius of $r_d$, a receding angle $\theta_r$ and an advancing angle $\theta_a$. The inertial force of jet impingement ($F_m$) scales as $$F_m \sim \frac{\Delta(mv)}{\Delta t} \sim \frac{\Delta m}{\Delta t} v_j \sim \pi \rho r_j^2 v_j^2 \tag{8}$$

where $v_j$ is jet velocity (assumed uniform and constant), $\Delta m/\Delta t$ is the incoming mass flow rate, ρ is liquid density, $r_j$ is jet radius. The capillary force due to contact-angle hysteresis is $$F_c \sim \pi \gamma r_d (\cos\theta_r - \cos\theta_a) \tag{9}$$

where γ is liquid surface tension, $r_d$ is the radius of the drop, and $\theta_r$ and $\theta_a$ are, respectively, the receding and advancing contact angles. Note $r_d$ is the radius of the contact area between the drop and the surface. To move a drop on a surface, the driving force needs to overcome the capillary force $F_c$ due to the difference in advancing and receding angles. Since the drops in our system are substantially smaller than the capillary length ($\sqrt{\gamma/\rho g}$~3 mm for water, where g is the gravitational acceleration), gravity alone can not drive drop motion on a substrate. In the EHD drop formation process reported here, $\rho \sim 1\times10^{-3}$ kg/m$^3$, $\gamma \sim 10^{-1}$ N/m (water); $r_j$~1 μm, $r_d$~10 μm (measured); $v_j$~1 nm/s (calculated from flow rate and jet diameter); $\theta_r$~90°, $\theta_a$~110°. Hence, $$\frac{F_m}{F_c} \sim \frac{\rho r_j^2 v_j^2}{\gamma r_d (\cos\theta_r - \cos\theta_a)} \sim 10^{-2}, \tag{10}$$

so the inertial force, even if applied parallel to the substrate, is two orders of magnitude less than the capillary force due to contact-angle hysterics. Hence, capillary forces serve to restrict center-of-mass motion of drops on the substrate.

Two important guidelines for improving positioning accuracy can be derived by comparing inertial and capillary forces, as in equation (9). First, gradual drop formation through jet accumulation is superior to abrupt drop formation due to reduced impingement forces. In de Gans and Schubert, inkjet drops of ~100 μm arrive at the substrate at ~1 nm/s speed, giving rise to a substantially larger inertial force ($F_m/F_c$~10); hence a slight deviation (~10°) from perpendicular arrival at the substrate can result in substantial center-of-mass drop motion. Second, there is an optimum contact angle for positioning accuracy. On a hydrophilic surface with very low contact angle, contact line pinning adversely affects positioning accuracy; on a superhydrophobic surface with contact angle approaching 180°, the contact area becomes so small ($r_d \rightarrow 0$) that a slight inertial force (or gravitational force) can overcome contact-angle hysteresis and lead to poor positioning accuracy.

Although single-particle delivery can be achieved in several consecutive drops as shown in FIG. 25*a*, the particle dosing statistics in EHD drops obeys a random Poisson distribution (FIG. 27). Equally sized drops are produced by a pulsed jet from a homogeneous aqueous suspension of 2 μm particles and fluorescent dye (inset). ■: The statistics of the number of particles per drop for 200 equally-sized, 42 μl colloidal drops; ▲: Poisson distribution for a measured average of 0.80 particles per drop. Electrical configuration: voltage=1.6 kV, nozzle-to-collector separation=90 μm, pulse duration=5 ms. Although the particle dispersion is homogeneous, particles arrive at the EHD nozzle in a random fashion. FIG. 27 is a representative result showing that the statistics of the number of particles per drop is essentially identical to the Poisson distribution. Poisson statistics is also observed in cell sorting in which individual cells are detected and sorted in a mechanically generated droplet stream. This similarity in dosing statistics indicates that the EHD process does not alter the random characteristics of particle arrival into the drops. Moreover, the similarity suggests that a gating mechanism resembling that used in fluorescence-activated cell sorting can be used to achieve single-particle dosing accuracy. Such a gating mechanism is under current investigation.

Single-particle drop-and-place can be applied to build complex micro and nanostructures particle by particle. Alternatively, EHD drop-and-place can be used as a technique for guided self assembly. Since electrohydrodynamics is solution-based, a variety of precursors including colloidal suspensions may be used to yield desired materials and structures. Integrating pick-and-place and self assembly in a single step, electrohydrodynamic drop-and-place provides a potential paradigm shift in the manufacturing of micro and nanostructures.

Preferred Embodiments

A thin (10 nm to 100 μm in diameter) and straight electrohydrodynamic (EHD) filament emerging from a Taylor cone and directly connecting to a surface formed with almost any liquid, including polymer solutions, polymer melts, and colloidal suspensions.

The oscillations of this filament as small as the diameter of the filament or less.

Oscillations of this filament decreased an order of magnitude upon decreasing the electrode-electrode separation.

By decreasing the volumetric flow rate, the length of the straight and intact filament is increased.

The length of the filament can be anywhere between a few microns to a few centimeters.

Under the same volumetric flow rate, continuous and steady emission of the liquid from the Taylor cone can depend on the electrode separation with polymeric solutions or polymeric melts.

Filament can be formed in any direction with respect to gravity.

The filament can be used to decorate surfaces.

Multiple nozzles are used to generate multiple filaments to allow for parallel printing.

By creating standing waves on a large liquid surface, multiple cones and multiple filaments are formed. This allows parallel patterning without multiple nozzles.

The charge on the filament is reduced or eliminated prior to deployment by exposing it to a plasma or an ionic liquid in order to increase the length of the intact filament if viscosity is large enough.

The charge on the filament is reduced or eliminated prior to deployment by exposing it to a plasma or an ionic liquid in order to enable printing on insulating surfaces.

The extent of evaporation from the filament mentioned in [0086] can be controlled during the travel time from cone to plate as well as on the substrate by controlling either the temperature of the surroundings, pressure of the surroundings, the volatility of the liquid, the exposed surface area or by the help of the hydrodynamics of the surroundings.

Ellipticity of cross section of deposited filaments on the surface is controlled by controlling the evaporation rate and hydrophilicity of the surface.

An electrohydrodynamic (EHD) fiber production system where a turntable is used to collect fiber; and in case of a high-molecular-weight polymer, to stretch the fiber.

An electrohydrodynamic (EHD) fiber production system where the fiber can be printed on a non-conducting surface through polymer stretching.

An EHD fiber production system where mechanical stretching is used to stretch the polymer filament to obtain finer (sub-micron) fiber.

An EHD fiber production system where the relative strength of mechanical stretching to electric stress is controlled by the turntable speed or electric field.

An EHD fiber production system for conductive fiber and woven mats by doping polymers with conductive particles such as carbon nanotubes and graphene nanoplatelets.

An EHD fiber production system for producing single crystal line of colloidal particles through controlled evaporation of the solvent after deployment onto the surface.

An EHD fiber production system where mechanical stretching is used to stretch the polymer filament to orient anisotropic particles.

An EHD fiber production system for aligning anisotropic particles and producing liquid crystalline structures.

Liquid used to form the filament can be a reaction mixture, which simultaneously react after exiting the cone.

Pattern produced by using the filament modified chemically or physically to alter its properties.

Filament deposited at the same location as multiple layers to form a three dimensional structure.

Filament deposited at the same location as multiple layers to form a three dimensional structure by cold welding the lines to each other through diffusional and viscous deformation processes.

When liquid used to form the filament contains anisotropic particles, particles align their major axis parallel to the centerline of the patterned line.

Surface to be patterned can have hydrophilic and hydrophobic regions to alter the structure of the final pattern.

An increase in mismatch of hydrophobicity and hydrophilicity of different areas on the surface improves the resolution of the pattern.

Surface pre-modification explained can be used to produce discontinuous structures with various aspect ratio, to change or vary the width of the pattern on the surface and to allow for self assembly mechanism for colloidal particles.

Filament can be composed of two or more liquids pumped from different sources to the nozzle and exist in the filament in concentric form.

Some of these liquids can be colloidal suspensions. Colloids can accumulate to the interface of the two liquids and crystallize at the surface by the help of capillary forces. If the inner liquid does not evaporate sufficiently, this can create hollow cylinders with colloidal crystal walls. If the inner liquid evaporates as the particles accumulate at the interface, particles can crystallize to form a three dimensional crystalline fiber. The outer liquid may or may not evaporate, which produces different types of fibers.

For a composite filament placing a low dielectric liquid in the core and high dielectric liquid at the outside layer results in a composite fiber which has a 'beaded fiber" core. This results in a larger interfacial area between the core and the shell.

The particles do not have to be spherical. In case of anisotropic particles, particles can also assume an orientation during the self-assembly process.

Deposition of the three dimensional crystalline fibers produced as explained in [0114] layer by layer generates three dimensional crystal structures.

The width of the pattern/diameter of the fiber can be kept uniform with +−10% variations.

Filament can be used to create membranes or sensors with uniform surface areas. Controlling the diameter of the fibers as well as the fiber-to-fiber separation can control the surface area density.

Filament can be used to produce organic electronic circuits.

Fibers with aligned rod-like particles can be deployed in desired directions to produce materials having anisotropic properties such as anisotropic conductivity, strength, and piezoelectricity.

Fibers can be woven uniformly to produce scaffolds, which will have homogeneous drug/nutrient release functions.

An electrohydrodynamic (EHD) system where external voltage pulse is used to generate drops from a long and thin nozzle, and where the flow rate is limited by the viscous drag on the nozzle wall.

An EHD drop production system where the nozzle is non-wetting to improve reproducibility of EHD cone-jet transition, and insulating to avoid electric breakdown and enlarge the operating regime of EHD drop formation.

An externally pulsed EHD system for on-demand drop formation where the maximum drop frequency (kilo-Hertz range) is achieved by matching the external pulses with the intrinsic pulsation frequency.

An externally pulsed EHD system for on-demand drop formation where the minimum drop size (micron and submicron diameter) is achieved in one intrinsic pulsation cycle.

An externally pulsed EHD drop formation system where the drop formation process is controlled by monitoring current in the EHD circuit.

An EHD drop formation system used to deploy colloidal suspension, particularly, to deploy colloidal particles one by one, or to deploy colloidal particles for self assembly.

An EHD drop-and-place system where micron-level positioning accuracy is achieved through gradual jet accumulation (vs. abrupt inkjet drop formation).

An EHD drop-and-place system where positioning accuracy is improved on a hydrophobic surface (vs. hydrophilic surface).

An EHD drop-and-place system where single-particle dosing accuracy is achieved using a gating mechanism (e.g. dielectrophoretic gating).

A drop-and-place system where good positioning accuracy is achieved using jet accumulation on a hydrophobic surface (e.g. using flow focusing).

A drop-and-place system where the positioning accuracy is improved by controlling the evaporation rate (i.e. shrinking drop by evaporation before deployment).

An EHD drop-and-place system that prints on non-conductive surface.

An EHD drop-and-place system for protein/DNA array.

An EHD drop-and-place system for reaction engineering.

An EHD drop-and-place system for deploying single cell/protein/molecule.

An EHD drop-and-place system for freeform solid formation.

An EHD drop-and-place system for encapsulation (e.g. colloidosome).

An EHD drop-and-place system for ultra-accurate pipetting.

An EHD drop-and-place system for pixelated, self-healing materials.

An EHD drop-and-place system for materials/drug screening.

An electrohydrodynamic fiber production system, comprising a turntable or an x-y table for collecting fiber or for stretching the fiber at velocities up to 5 m/s; a syringe pump for supplying a polymeric solution or suspension, said syringe pump having a needle; and a device for applying an electric filed between said needle and a counter electrode; wherein said system is capable of producing filaments having a diameter of from 10 nm to 100 μm.

An electrohydrodynamic fiber production system as described in [0146], wherein the turntable or x-y table comprises a substrate having a non-conducting surface onto which said fiber is printed through polymer stretching at velocities up to 5 m/s.

U.S. provisional application No. 60/731,479, filed Oct. 31, 2005, is incorporated herein by reference in its entirety.

The invention claimed is:

1. A method of obtaining an electrohydrodynamic filament, comprising:

causing a straight and intact electrohydrodynamic filament formed from a liquid to emerge from a Taylor cone between a first and a second electrode that are separated from each other such that said filament directly connects to a surface of said second electrode and adjusting the separation distance between said first and second electrodes and/or the volumetric flow rate at which said liquid emerges from said Taylor cone such that said filament has a diameter of from 10 nm to 100 μm, stretching said filament, and depositing said filament as a printed pattern onto said second electrode.

2. The method of claim 1, wherein said filament exhibits oscillations as small as the diameter of the filament or less.

3. The method of claim 1, wherein said liquid is selected from the group consisting of polymer solutions, polymer melts, and colloidal suspensions.

4. The method of claim 1, wherein said filament exhibits oscillations which are decreased by an order of magnitude upon decreasing an electrode-electrode separation.

5. The method of claim 1, wherein a length of the straight and intact filament is increased by decreasing a volumetric flow rate of said liquid.

6. The method of claim 1, wherein a length of said filament is between a few microns to a few centimeters.

7. The method of claim 1, wherein said filament can be formed in any direction with respect to gravity.

8. The method of claim 1, wherein an extent of evaporation from said filament is controlled during the travel time from cone to plate as well as on the substrate by controlling either the temperature of the surroundings, pressure of the surroundings, the volatility of the liquid, the exposed surface area or by the hydrodynamics of the surroundings.

9. The method of claim 8, wherein an ellipticity of cross section of deposited filaments on a surface is controlled by controlling an evaporation rate and hydrophilicity of the surface.

10. The method of claim 1, wherein the filament comprises a conductive polymer.

11. The method of claim 1, wherein the filament comprises a polymer and a conductive particle.

12. The method of claim 1, wherein the filament comprises a polymer and carbon nanotubes.

13. The method of claim 1, wherein the filament comprises a polymer and graphene nanoplatelets.

14. The method of claim 1, wherein the substrate is silicon.

15. The method of claim 14, wherein the silicon substrate is coated with chrome or gold.

16. The method of claim 1, wherein the liquid is a reaction mixture that simultaneously reacts after exiting the cone.

17. The method of claim 1, wherein the pattern is a organic electronic circuit.

18. The method of claim 1, wherein the substrate is non-conducting.

* * * * *